US008449367B2

(12) United States Patent
Kitamura et al.

(10) Patent No.: US 8,449,367 B2
(45) Date of Patent: May 28, 2013

(54) GAMING MACHINE CAPABLE OF BEING PLAYED BY A PLURALITY OF PLAYERS AND DIVIDING THE PRIZE AMONG THEM

(75) Inventors: Kenta Kitamura, Koto-ku (JP); Yoichi Kato, Koto-ku (JP); Makoto Miyawaki, Koto-ku (JP); Hiromoto Yamauchi, Tokyo (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 37 days.

(21) Appl. No.: 13/068,863

(22) Filed: Jun. 6, 2011

(65) Prior Publication Data

US 2012/0309509 A1 Dec. 6, 2012

(51) Int. Cl.
*A63F 9/24* (2006.01)

(52) U.S. Cl.
USPC ..... 463/16

(58) Field of Classification Search
USPC ..... 463/16–20
See application file for complete search history.

(56) References Cited

U.S. PATENT DOCUMENTS

2002/0010018 A1* 1/2002 Lemay et al. ..... 463/20
2007/0281775 A1* 12/2007 Kashima ..... 463/20
2011/0177857 A1* 7/2011 Mound ..... 463/19

OTHER PUBLICATIONS

And Your Reward is Clothes. TvTropes.org. Online. Jul. 21, 2008. Accessed via the Internet. Accessed Sep. 7, 2012. <URL:http://tvtropes.org/pmwiki/pmwiki.php/Main/AndYourRewardIsClothes>.*

* cited by examiner

*Primary Examiner* — Dmitry Suhol
*Assistant Examiner* — Carl V Larsen
(74) *Attorney, Agent, or Firm* — Lexyoume IP Meister, PLLC

(57) ABSTRACT

When one player acquires a qualification for playing a scramble bonus game, another player can participate in the scramble bonus game by paying a predetermined amount of participation charge. In addition, in a case where a fellow character could be acquired as a fellow of the player characters, the amount of prize to be paid to the players is increased according to features of that fellow character. Further, items of equipment of the player characters become more gorgeous, as the prizes acquired by the players increase in amount. A damage imparted to an enemy character varies depending on weapons that the player characters use. A prize is awarded when a hit point of the enemy character becomes 0.

5 Claims, 11 Drawing Sheets

GAMING MACHINE CAPABLE OF BEING PLAYED BY A PLURALITY OF PLAYERS AND DIVIDING THE PRIZE AMONG THEM

BACKGROUND OF THE INVENTION

1. Field of the Invention

The present invention relates to a gaming machine which is capable of playing a role playing game by a plurality of players and then dividing a prize based on a result of the role playing game.

2. Description of the Related Art

Conventionally, there exist gaming machines in which symbol arrays made of a plurality of reels are varied and then rearranged, and according to the rearranged symbols or a symbol combination, a prize is awarded to a player. Such gaming machines are disclosed in United State Patent Application Publication No. 2008/0058067 and United State Patent Application Publication No. 2008/0058072, for example.

However, in the conventional gaming machines, a player plays a game independently at each of the gaming machines. Thus, the player has executed a game so as to play a match with the gaming machine. Therefore, the progress of the game becomes likely to be monotonous, and the player easily loses an interest in the game. In addition, a player has executed the game so as to play a match with the gaming machine. Thus, the player has won or has lost a prize from a gaming facility such as a casino. Hence, in a case where a gaming facility manager makes a profit, the gaming facility manager gains a profit, whereas a player has not been happy. On the other hand, in a case where a gaming facility manager loses a profit, a player is happy, whereas the gaming facility manager could not gain a profit.

The present invention has been made in view of the above-described circumstance. It is an object of the present invention to provide a gaming machine which is capable of variously expanding the progress of a game. In addition, it is another object of the present invention to provide a gaming machine in which a player can enjoy a game, and at the same time, a gaming facility manager can gain a profit.

SUMMARY OF THE INVENTION

A gaming machine including:

an operating device that enables a first player and a second player to operate in order to advance a game;

a display that is capable of displaying a first player character corresponding to the first player and a second player character corresponding to the second player; and a controller that is programmed to execute processing operations of:

(1-1) when a first condition is established in a first game in which the first player plays, establishing a state in which the first player can start a second game to play a match with an enemy character;

(1-2) when a state in which the second game can be started is established, displaying on a display, information for inquiring whether or not the first player character and the second player character play a match with the enemy character in collaboration in the second game;

(1-3) when a signal indicating that the first and second player characters play a match with the enemy character in collaboration is output from the operating device in accordance with an operation of the second player, determining whether or not a signal indicating a predetermined participation charge is output from the operating device in accordance with the operation of the second player; and (1-4) when the signal indicating the predetermined participation charge is outputted, executing as the second game a game in which the first player characters and the second player character play a match with the enemy character in collaboration.

A first player and a second player play a match with an enemy character in collaboration. Thus, a first player and a second player advance a game in cooperation, so that intentions of the plurality of players can be reflected in the game, and the progress of the game can be variously expanded. In addition, a predetermined participation charge is paid and then a second game is played. Thus, in a case where an attempt is made to pay a prize from the predetermined participation charge, the players can enjoy the game without imparting a disadvantage to a gaming facility.

The controller executes processing operations of:

(2-1) when a second condition is established in the first game, displaying on the display a fellow character that is capable of become a fellow between the first player character and the second player character and that plays a match with the enemy character; and (2-2) determining whether or not the fellow character is handled as a fellow of the first player character, based on an operation of the operating device by the first player.

A fellow character is allowed to appear, so that the progress of a game can be variously expanded.

the controller executes processing operations of:

(3-1) determining a prize to be awarded to the first player and the second player in accordance with a match play result of the second game; and (3-2) determining an item of equipment that the first player character or the second player character is allowed to have, in accordance with a size of the prize.

A player can visually recognize items of equipment which a player is allowed to have, and can expect a prize to be awarded to the player by the items of equipment.

the controller executes processing operations of:

(4-1) enabling the first player character or the second player character to select from a weapons of plural type a weapon that is employed to play a match with the enemy character in the second game;

(4-2) determining a severity of a damage to be imparted to the enemy character in accordance with a type of the selected weapon; and (4-3) determining a damage of the enemy character in the second game, and then determining a prize to be awarded to a player on condition that the severity of the determined damage becomes equal to or greater than a predetermined level.

A prize is determined in accordance with contribution to a second game, thus enabling a player to positively participate in a game.

the controller executes processing operations of:

(5-1) displaying on the display a map enabling the first player character to move along a predetermined route;

(5-2) displaying on the display a predetermined number of a die, based on the operation of the operating device by the first player;

(5-3) causing the first player character to move to a stop position according to the predetermined number along the route; and (5-4) defining a condition for establishing the first condition being a fact that the first player character stops at a first stop position.

A first game migrates to a second game, so that a player can play the first game while expecting that the first game may migrate to the second game.

the controller executes processing operations of:

(6-1) when the first player character moves from a frontal direction to a depth direction of the map in the processing operation (5-1), determining whether or not the first player character is positioned at a predetermined depth side on the map; and (6-2) when the first player character is positioned at the predetermined depth side on the map, redisplaying the depth side of the map on the display in an enlarged manner.

A map can be displayed in accordance with the progress of a game so that a player can visually recognize the map.

BRIEF DESCRIPTION OF THE DRAWINGS

FIG. 2(*b*) is a front view schematically showing a payout of a screen of the entire gaming machine; and FIG. 2(*c*) is a front view schematically showing a layout of a screen of a game terminal.

DESCRIPTION OF THE PREFERRED EMBODIMENTS

Figure 1:
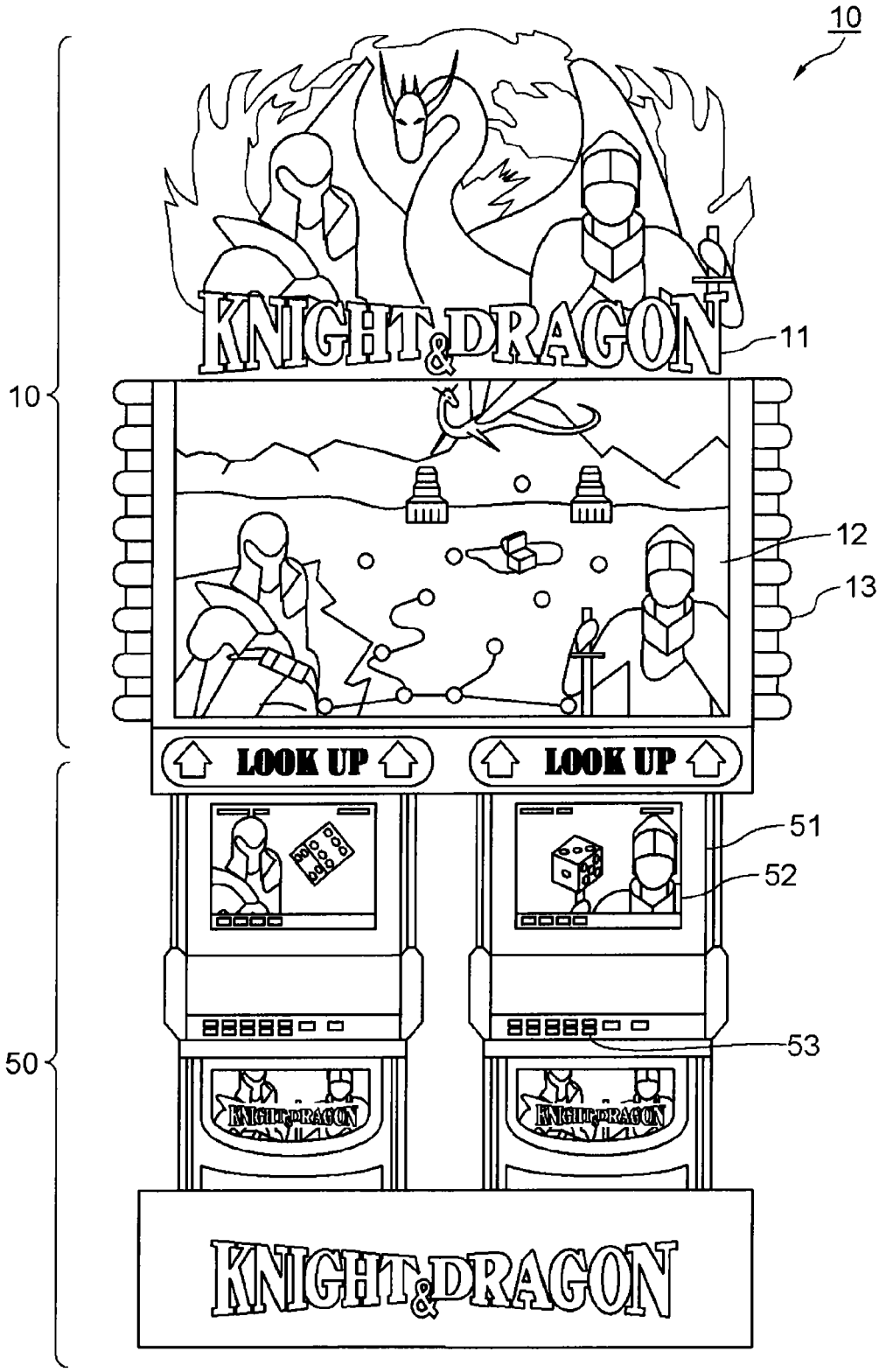
FIG. 1 is a front view schematically showing a gaming machine according to a first embodiment of the present invention.

Hereinafter, an embodiment of the present invention will be described with reference to the drawings.

General Description of the Embodiment of the Invention

A gaming machine according to the embodiment of the present invention has: an operating device for a player to be able to advance a game; a controller for controlling a game; a display for displaying information relating to a game; and a memory for storing a variety of data. The controller executes a variety of processes relating to a game.

(0-1) The controller displays a map indicating a predetermined territory, region, or land on a display. The map additionally includes: a stop position at which a character stops; a route in which the character moves; an object such as a dollar box; or a goal that is a final point at which the character arrives, such as a community, a village, or a building, and the map is displayed on the display, whereby an image indicating the stop positions, final points, and routes is also displayed on the display.

(0-2) The controller allows a player character that can reflect an operation of an operating device by a player to appear on a map and then display the player character on the display. There appear one player character corresponding to one player and another player character corresponding to another player that is different from such one player. One player is a player who plays a game at one gaming machine. Another player is a player who plays a game at another gaming machine that is different from such one gaming machine. One gaming machine and another gaming machine are connected so as to enable communication with each other. If one gaming machine is one's own gaming machine, another gaming machine is a gaming machine that is different from such one's own gaming machine, and is a gaming machine that is connected to enable communication with such one's own gaming machine.

The controller mainly performs processing so as to perform the following games (1-1) to (1-4).

(1-1) If one player acquires a qualification of a scramble bonus game, another player can participate in the bonus game by paying a predetermined amount of participation charge.

(1-2) In a case where a fellow character could be acquired as a fellow of player characters, a prize to be paid to a player according to features of that fellow character is increased in amount. The fellow character is a non-player character that cannot reflect a player operation.

(1-3) Items of the player characters becomes more gorgeous, as the prizes acquired by the players increase in amount.

(1-4) Damage to be imparted to an enemy character changes depending on weapons that the player characters use. A prize is awarded when a hit point (HP) of the enemy character is set to 0. The enemy character is also a non-play character that cannot reflect a player operation. In addition, the hit point denotes a parameter numerically indicating a damage quantity that is imparted by a variety of characters appearing in a game being attacked by the enemy character, and denotes one of the features adapted to characterize the variety of characters. In other words, the hit point also denotes a parameter indicating a feature of durability of that character.

The controller schematically executes a variety of processes descried below.

(1-1-1) When a predetermined condition is established, the controller imparts a qualification of playing a scramble bonus game to one player and enables another player that is different from such one player to participate in the scramble bonus game on condition that a predetermined amount of participation charge is paid.

Hereinafter, a scramble bonus game is referred to as a game in a match play mode or is merely referred to as a match play game.

(1-1-2) When a predetermined condition is met, in a case where a fellow character is allowed to appear on a map and then a player could acquire the fellow character as a fellow of the player characters, the controller increases a prize to be paid to the player in amount in accordance with features of that fellow character.

(1-1-3) The memory stores: a prize item determination table defining an interrelationship among prizes, items of equipment, and types; and image data for displaying items of equipment. In a case where a player has acquired more prizes, the controller determines items of equipment according to the prizes and then displays player characters and items of equipment on the display. The image data on the items of equipment is defined so as to enable more gorgeous items of equipment to be acquired as more prizes are awarded, and the defined image data is stored in the memory.

(1-1-4) The memory stores a weapon damage determination table defining an interrelationship between a weapon that player characters uses and a damage that is imparted to the enemy character. The controller determines the damage that is imparted to the enemy character and then computes a hit point (HP) of the enemy character in accordance with the weapon that the player characters uses. When the hit point of the enemy character has been set to 0, the controller causes the memory to store information relating to a prize to be awarded to a player.

In addition, it is preferable that the controller of the gaming machine according to the embodiment of the present invention execute the following processes relating to a game.

(2-1) The controller randomly determines dice numbers and then displays the determined dice numbers on the display. Next, the controller displays a player character to move and stop in a map on the display by the determined dice numbers. Specifically, a controller of one gaming machine at which one player plays a game first randomly determines the dice numbers, displays the determined dice numbers on the display, and then, displays one player character to move and stop in the map on the display by the determined dice numbers. Similarly, a controller of another gaming machine at which another player plays a game randomly determines dice numbers, displays the determined numbers on the display, and then, displays another player character to move and stop in the map on the display by the determined dice numbers.

(2-2) The memory stores route data for defining a plurality of routes in a map. A plurality of stop positions at which a player character stops is defined in each of the plurality of routes. The memory stores a plurality of stop position data for defining a plurality of stop positions. A goal corresponding to each of the plurality of routes is defined. The memory stores position data for defining the goal.

A controller of one gaming machine at which one player plays a game controls one player table configured to define a character corresponding to one player to move toward one goal along one route. Similarly, a controller of another gaming machine at which another player plays a game controls another player character corresponding to another player to move toward another goal along another route. In this way, the controller of one gaming machine controls one player character, whereas the controller of another gaming machine controls another player character. That is, as long as the routine does not migrate to a game in a match play mode, one player plays a game in accordance with the controller of one gaming machine, whereas another player plays a game in accordance with the controller of another gaming machine. In this manner, as long as the routine does not migrate to the game in the match play mode, one player and another player play a game separately independently and then their player characters move to the respective goals along the respective routes. When the routine has moved to the game in the match play mode, the controller controls one player and another player to advance a game in collaboration.

(2-3) The memory stores a stop position mark determination table configured to define an interrelationship between a stop position and a mark such as an object such as a dollar box, a community, a village, or a building. The controller displays an image indicating a mark such as a building at a stop position.

The memory stores a stop position event determination table defining an interrelationship between a stop position and an event type. By doing this, an event corresponding to a building can be predetermined. When a player character has stopped at a stop position, the controller generates an event according to that stop position. For example, when a player character has stopped at a stop position indicating a dollar box, the controller awards a predetermined prize to a player. In addition, when one player character has stopped at an appropriate stop position such as a specific community or a specific village, the controller of one gaming machine awards a qualification of playing a game in a match play mode to one player. When a player character has stopped at a stop position that is not a specific image such as a simple circular mark, no event is generated.

(2-4) The display is a common display that is common to a plurality of players. A game in a match play mode is a game to be displayed on the common display. For example, both of the controller of one gaming machine and the controller of another gaming machine are connected to the common display.

A common controller for controlling the common display is provided. The common controller is connected to enable communication with the controller of one gaming machine and the controller of another gaming machine.

The controller of one gaming machine transmits game progress information relating to a progress to the common controller in accordance with the progress of a game of one player. The common controller controls the common display in accordance with the transmitted game progress information. In this way, an image of a game relating to one gaming machine can be displayed on the common display.

Similarly, the controller of another gaming machine transmits game progress information relating to a progress to the common controller in accordance with the progress of a game of another player. The common controller controls the common display in accordance with the transmitted game progress information. In this way, an image of a game relating to another gaming machine can be displayed on the common display.

In addition, the common controller transmits game progress information relating to a progress to the controller of one gaming machine and the controller of another gaming machine in accordance with the progress of a game executed by using the common display. The controller of one gaming machine and the controller of another gaming machine can reflect a player operation by using the game progress information that is transmitted from the common controller in a game that is executed in one gaming machine or another gaming machine.

In this manner, the controller of one gaming machine, the controller of another gaming machine, and the common controller communicate with each other to thereby able to control the progress of games while achieving a coordination between each of the games executed individually in one gaming machine and another gaming machine and a match play mode game executed by using the common display.

In addition, the common display may be controlled by means of the controller of one gaming machine or the controller of another gaming machine.

For example, the controller of one gaming machine controls the common display in accordance with the progress of a game of one player, and the controller of another gaming machine controls the common display in accordance with the progress of a game of another game. In addition, a display common to the game of one player and the game of another player can be controlled by means of the controller of either of the gaming machines. One gaming machine and another gaming machine are connected to enable communication with each other, so that: these gaming machines can communicate with each other to exchange required information in accordance to the progress of the games; and the display common to the game of one player and the game of another player can be controlled by means of the controller of either of the gaming machines.

(2-5) When a player character has moved a predetermined distance, the controller scrolls a map and then displays the scrolled map on the display. The display is a common display that is common to a plurality of players, and thus, it is required to display one player character corresponding to one player and another player character corresponding to another player on the common display at the same time. Therefore, the controller of one gaming machine transmits positional information on one player character to the common controller, and the controller of another gaming machine transmits positional information on another player character to the common controller. The common controller determines whether or not to enable scroll from the respective items of the positional information transmitted and then scrolls the map on the common display when determining such scroll is enabled.

In addition, it may be that: the controller of one gaming machine transmits the positional information on one player character to another gaming machine; the controller of another gaming machine transmits the positional information on another player character to one gaming machine; and the controller of one gaming machine and the controller of another gaming machine determines whether or not to enable scroll and then scroll the map on the common display when both of them determines such scroll.

In a case where both of one player character and another player character cannot be displayed at the same time and in a case where scroll is disabled, a size of a screen that is displayed on the common display may be changed. In addition, in a case where scroll is disabled, the controller may adjust numbers of dice to be determined and then determine a distance at which one or both of the player characters moves or move, so as to display one or both of the player characters.

(2-5) The controller controls the routine to revert to a start position in a map when the player character stops at an END position or a player makes a CASH OUT operation.

(2-6) The memory stores a plurality of items of map data. The controller randomly selects one item of the plurality of map data whenever returning to the a start position and then displays a map on the display by using the selected item of map data.

(2-7) At a stop position, there is a branch point at which a route branches, and the controller detects an operation of an operating means by a player and then selects a route that a player desires.

(2-8) There are a plurality of types of fellow characters, and the memory stores a compatibility table that is configured to define types of fellow characters and an interrelationship in compatibility with player characters. In a case where compatibility between a fellow character and a player character is good, features such as attacking power or defensing power become strong as a party, and more prizes are awarded in a game of a match play mode as a whole. On the other hand, in a case where compatibility between a fellow character and a player character is not good, the features become weak as a party, and the entire prizes to be awarded in a game of a match play mode become less.

(2-9) When a fellow character has been allowed to appear, the controller causes a player to operate an operating device and then causes the player to select whether or not the fellow character having appeared is handled as a fellow. By doing this, the player's intention can be reflected in a game.

Further, it is preferable that the controller of the gaming machine according to the embodiment of the present invention execute the following processing relating to a game.

(3-1) The controller of one gaming machine determines whether or not the routine migrates to a match play mode for playing a match with an enemy character while triggering the fact that one player character has stopped at a predetermined stop position. One player character has stopped at the predetermined stop position, whereby one player can acquire a qualification of playing a game in a match play mode.

It may be determined whether or not the routine migrates to a match play mode for playing a match with an enemy character, as triggered by the fact that the enemy character has moved to close to one player character. For example, the controller of one gaming machine may control the enemy character to gradually move a map and determine whether or not the routine migrates to a match play mode for playing a match with the enemy character, as triggered by the fact that a distance between the enemy character and one player character has been within a predetermined distance.

(3-2) When one player character has stopped at a predetermined stop position, the controller of one gaming machine transmits to another gaming machine a participation inquiry signal indicating inquiry as to whether or not to participate in a game of a match play mode.

When receiving the participation inquiry signal, the controller of another gaming machine displays on the display a message indicating whether or not to participate in the game of the match play mode. Another player can select whether or not to participate in the game by operating an operating device of another gaming machine. In a case where another player has selected the participation, a message indicating that a participation charge is input is displayed on the display. Another player inputs the participation charge by operating the operating device of another gaming machine. In a case where the participation charge has been input, the controller of another gaming machine transmits a signal indicating the participation charge to one gaming machine. On the other hand, in a case where a player has not selected the participation, the controller of another gaming machine transmits a signal indicating no participation to one gaming machine.

When another player has desired to participate in the game of the match play mode, the controller of another gaming machine sets a flag indicating that the player has desired to participate therein. The controller of one gaming machine can determine whether or not another player participates therein by reading out a value of that flag.

Alternatively, when another player has desired to participate in the game of the match play mode, the controller of another gaming machine may transmit to one gaming machine a participation desiring signal indicating that the player has desired to participate therein.

(3-3) The memory stores a participation charge—enemy character determination table configured to define an interrelationship between a participation charge and an enemy character. The controller of one gaming machine determines an enemy character having its power according to a transmitted participation charge and then displays the determined enemy character on the common display to thereby cause the enemy character to appear in a game of a match play mode.

(3-4) In addition, when one player character has stopped at a predetermined stop position, it may be that: the controller of one gaming machine first determines an enemy character; determines a required participation charge in accordance with the power of the enemy character; and then, transmits a signal indicating the required participation charge to another gaming machine together with a participation inquiry signal indicating inquiry as to whether or not to participate in a game of a match play mode.

The controller of another gaming machine displays a minimum participation charge required for participation on the display together with a message indicating whether or not to participate in the game of the match play mode.

(3-5) When receiving a signal indicating a participation charge from another gaming machine or a participation desiring signal indicating that a player has desired to participate, the controller of one gaming machine causes the routine to migrate to a match play mode and then transmits to another gaming machine a signal indicating that the routine has migrated to the match play mode.

(3-6) In addition, in a case where no player desires to participate in a game of a match play mode, the controller of one gaming machine controls one player character to play a match with an enemy character alone.

In the case where no player desires to participate in the game of the match play mode, when a fellow character has already been acquired, the controller of one gaming machine may control one player character and the fellow character to play a match with an enemy character.

In addition, in the case where no player desires to participate in the game of the match play mode, when a fellow character has not been acquired yet, the controller of one gaming machine causes a fellow character that becomes on the side of one player character to appear and then controls one player character and the fellow character to play a match with an enemy character in collaboration. Thus, in the case where one player character and the fellow character play a match in collaboration, the game of the match play mode is completed so as to lessen a prize to be awarded to one player or another player in comparison with a case in which one player character and another player character play a match in collaboration. Since there is no participation charge from another player, a prize awarded to a player is lessen in advance, whereby a prize to be provided from a gaming facility such as casino can be lessen, and a financial loss in the gaming facility can be lessened.

(3-7) When the routine has migrated to a match play mode, the controller of one gaming machine executes a game of the match play mode. The game of the match play mode is a game in which one player and another player plays a match with an enemy character in collaboration. The controller of one gaming machine displays an image of the game of the match play mode on the common display. The controller of one gaming machine transmits game progress information indicating the progress of the game of the match play mode to another gaming machine. The controller of another gaming machine can control the progress of the game of the match play mode by receiving the game progress information.

The game of the match play mode employs a turn system in which one player character corresponding to one player, another player character corresponding to another player, and an enemy character alternately play a match with each other. That is, the turn system consists of: a turn in which one player character attacks an enemy character; a turn in which an enemy character attacks one player character; a turn in which another player character attacks an enemy character; and a turn in which an enemy character attacks another player character.

The turn in which the enemy character attacks may be the one in which the enemy character attacks both of one player character and another player character. By doing this, the number of turns can be reduced, the progress of a game can be accelerated, and a player hardly loses his or her interest in the game.

The turn in which one player character attacks an enemy character is started by one player operating an operating device of one gaming machine to place a BET and then roll dice. The contents of an attack of one player character are determined by the dice numbers and then the power of the attack is determined by the betted amount of money. One gaming machine stores an attach type determination table configured to define an interrelationship between dice numbers and attack types. For example, when the dice number is 1, it is determined to be a punch, and when the dice number is 6, it is determined to be a special move. The controller of one gaming machine computes values of the characterizing features of characters such as a hit point between one player character and an enemy character in accordance with the contents of the determined attack and the power of the attack. The controller of one gaming machine transmits the computed values of features to another gaming machine. Another gaming machine receives the transmitted values of features and then prepares for a further turn.

The turn in which another player character attacks an enemy character is started by another player operating an operating device of another gaming machine to place a BET and roll dice. The contents of an attack of another player character are determined by the dice numbers and then the power of the attack is determined by the betted amount of money. Another gaming machine stores an attach type determination table configured to define an interrelationship between dice numbers and attack types. For example, when the dice number is 1, it is determined to be a punch, and when the dice number is 6, it is determined to be a special move. The controller of another gaming machine computes values of the characterizing features of characters such as a hit point between another player character and an enemy character in accordance with the contents of the determined attack and the power of the attack. The controller of another gaming machine transmits the computed values of features to one gaming machine. One gaming machine receives the transmitted values of features and then provides for a further turn.

The turn in which an enemy character attacks one player character allows the controller of one gaming machine to randomly determine the contents of an attack of the enemy character and the power of the attack and then compute values of features such as a hit point between one player character and the enemy character. The controller of one gaming machine transmits the computed values of features to another gaming machine. Another gaming machine receives the transmitted value of features and then provides for a further turn.

The turn in which an enemy character attacks another player character allows the controller of another gaming machine to randomly determine the contents of an attack of the enemy character and the power of the attack and then compute values of features such as a hit point between another player character and the enemy character. The controller of another gaming machine transmits the computed values of features to one gaming machine. One gaming machine receives the transmitted value of features and then provides for a further turn.

As described above, the common controller controls the common display in accordance with the progress of a game of one player. Therefore, the turn in which one player character attacks an enemy character or the turn in which an enemy character attacks one player character, in principle, allows the controller of one gaming machine and the common controller to communicate with each other to control the progress of a game and to control display of the common display. In such a turn as well, one gaming machine and another gaming machine can communicate with each other to exchange game progress information, so that a game can be controlled by means of equipment including the controller of another gaming machine.

Similarly, the common controller controls the common display in accordance with the progress of a game of another player. Therefore, the turn in which another player character attacks an enemy character or the turn in which an enemy character attacks another player character, in principle, allows the controller of another gaming machine and the common controller to communicate with each other to control the progress of a game and to control display of the common display. In such a turn as well, another gaming machine and one gaming machine can communicate with each other to exchange game progress information, so that a game can be controlled by means of equipment including the controller of one gaming machine.

In addition, in a variety of turns, the common controller controls a display that is common to a game of one player and a game of another player. The controller of one gaming machine, the controller of another gaming machine, and the common controller can communicate with each other to exchange game progress information, so that the controller controls the display that is common to the game of one player and the game of another player.

Further, in a map, a fellow character may be acquired as a fellow of the player characters. In a case where one player character has acquired a fellow character before the routine migrating to a match play mode, one player character collaborates with the fellow character in party and then moves to a goal in the map. When the routine has migrated to the match play mode, one player character plays a match with an enemy character in collaboration with another player character, including this fellow character. Similarly, in a case where another player character has acquired the fellow character before the routine migrating to the match play mode, another player character collaborates with the fellow character in party and then moves to a goal in the map. When the routine has migrated to the match play mode, another player character plays a match with an enemy character in collaboration with another player character, including this fellow character.

In addition, in a case where one player character and another player character collaborate with a fellow character in party before the routine migrating to the match play mode, one player character and another player character play a match with an enemy character in collaboration, including fellow characters of both of them. In this way, in the case where one player character and another player character have acquired the fellow character, the controller controls the player characters to play a match with an enemy character, including the fellow character. Specifically, there occurs the turn in which the fellow character and the enemy character play a match with each other as well as the turn in which one player character, another player character, and the enemy character play a match with each other.

Further, the sequential order in which one player character, another player character, and a fellow character play a match with an enemy character can be determined in accordance with a variety of feature of the characters such as attacking power or can be determined by a player.

The controller of one gaming machine and the controller of another gaming machine completes a game of a match play mode when values of predetermined features indicating the features of the player character, enemy character, and fellow character are set at predetermined values. For example, the game of the match play mode is completed when a hit point of any one of the player characters, the enemy character, and the fellow character has been set to 0.

(3-8) The controller determines a prize between one player and another player in accordance with a result of a game of a match play mode, for example, in accordance with a degree of contribution in the game of the match play mode. It is preferable that damage imparted to an enemy character be handled as the degree of contribution. For example, during the play of the game of the match play mode, a divisional rate of the prize is determined in accordance with a ratio between a cumulative value that is obtained when one player character has decreased the number of hit points of the enemy character and a cumulative value that is obtained when another player character has decreased the number of hit points of the enemy character. A prize may also be determined by using other features of one player character, another character, or the enemy character, for example, individual features such as attacking power or defensing power, or alternatively, compatibility between one player character and another player character, etc.

(3-9) The memory stores data relating to items of equipment with which a player character is allowed to have. When the player character has stopped at a predetermined stop position, the controller causes the player character to have items of equipment that are defined at the stop position. The items of equipment of the player character are displayed on the display to thereby enable a player to visually recognize and enjoy the game. In addition, the items of equipment is made gorgeous as more prizes are awarded, thereby enabling a player to feel a sense of fulfillment or a sense of achievement. In a gaming machine of recent years, a prize to be awarded to a player is numeric data that is stored in a storage medium such as an IC card in place of substantive materials such as medals. Therefore, a player hardly realizes that even if a prize is awarded, he or she has obtained the prize. The items of equipment the player character wears are made gorgeous and then the player is caused to visually recognize the items of equipment to thereby enable the player to alternatively feel that the prize has been awarded.

(3-10) Features of the player characters may be defined by determining compatibility between players based on information relating to the players. The information relating to the payers is stored in a server of a gaming facility such as casino. Many of the gaming machines in recent years have a player tracking system (PTS). The player tracking system is a system for reading player identification information that is stored in an IC card set in a reader that is provided in the gaming machine and then managing a variety of information required for a player. The controller can acquire the information relating to the players from the server by transmitting to the server of the gaming facility the identification information that the player tracking system has read out from the IC card.

The controller can determine the compatibility between the players by using the information relating to the players that has been acquired from the server. In a case where the compatibility between the players is good, the player characters can play a match with an enemy character in collaboration in a game of a match play mode. On the other hand, in a case where the compatibility between the players is not good, the player characters can play a match with an enemy character separately in a game of a match play mode. For example, in a case where both of two players are males, they can play an enemy character while taking advantages of their player characters, or alternatively, in a case where one of two players are a male and the other is a female, they can play a match with an enemy character so as to compensate for weak points of their player characters.

(3-11) In a case where a player character moves toward a goal on a map, even in a region in which a route or a geographical feature or the like cannot be displayed in detail because of its distant position, when a game advances and then the player character approaches that region, the route or geographical feature of the region is displayed on the display in an enlarged manner. That is, the controller modifies and reads out map data for indicating a region having moved as the player character moves in a map depth direction and then provides an enlarged scroll-display to display a map depth portion on the display in an enlarged manner.

(3-12) When a variety of characters are displayed on a map, it is preferable that the characters be displayed in a reduced manner or pieces indicating the characters be displayed. In particular, in a case where it is indicated that the characters are at a predetermined stop position, images indicating the characters themselves may be displayed, whereas the pieces indicating the characters are displayed to be able to simplify the display and to prevent the display from being complicated. The pieces may be images that have been abstracted so as to enable players to visually recognize that the pieces indicate the characters. For example, images such as circles or squares of predetermined colors can be handled as the pieces.

Specific Configuration of the Embodiment of the Present Invention

In a gaming machine 1 according to the embodiment of the present invention, a game is not played in such a manner that a plurality of symbols in symbol matrixes or reels are rearranged in each unit game. That is, a unit game in which symbols are scrolled and then rearranged is not played. A game in the gaming machine 1 is mainly played in accordance with the following steps:

(1) Place a bet required for rolling dice.

(2) Roll the dice.

(3) Allow a character to move frames in a map by dice values.

(4) Perform an event according to a frame at which the character has stopped and then pay a prize according to a result of the event.

(5) Revert to step (1) above.

In the gaming machine 1 according to the embodiment of the present invention, a unit game is configured to be played in accordance with the steps (1) to (5) above.

The number of credits required for betting in the step (1) described above is fixed to a predetermined number in principle. When a player plays a game of a match play mode to be described later, the player can bet a desired number of credits as long as it is equal to or smaller than a maximum number. Attacking power of attacking an enemy character can be defined depending on the number of bets. As the map described above, there is employed a map that is randomly selected from among a plurality of different maps when a game is started. For example, one map is selected by means of lottery processing.

FIG. 1 is a front view schematically showing a gaming machine according to a embodiment of the present invention.

A gaming machine 1 is provided with a common portion 10 and a plurality of game terminals 50 (for example, two game terminals). The two game terminals 50 are disposed side by side. The common portion 10 is installed over the two game terminals 50 at an upper portion of the two game terminals 50.

The common portion 10 is provided with a panel 11. On an upper side of the panel 11, decoration is applied, and at a lower side of the panel 11, a common display device 12 is engaged. At both side parts of the common display device 12, a plurality of LEDs 13 are installed. On the panel 11, a speaker 14 is installed (not shown).

The game terminal 50 is provided with a cabinet 51. At an upper center of the cabinet 51, a terminal display device 52 is installed. At a lower side of the terminal display device 52, a control panel 53 is installed. On the control panel 53, a variety of input devices (to be described later) are installed.

Figure 2:
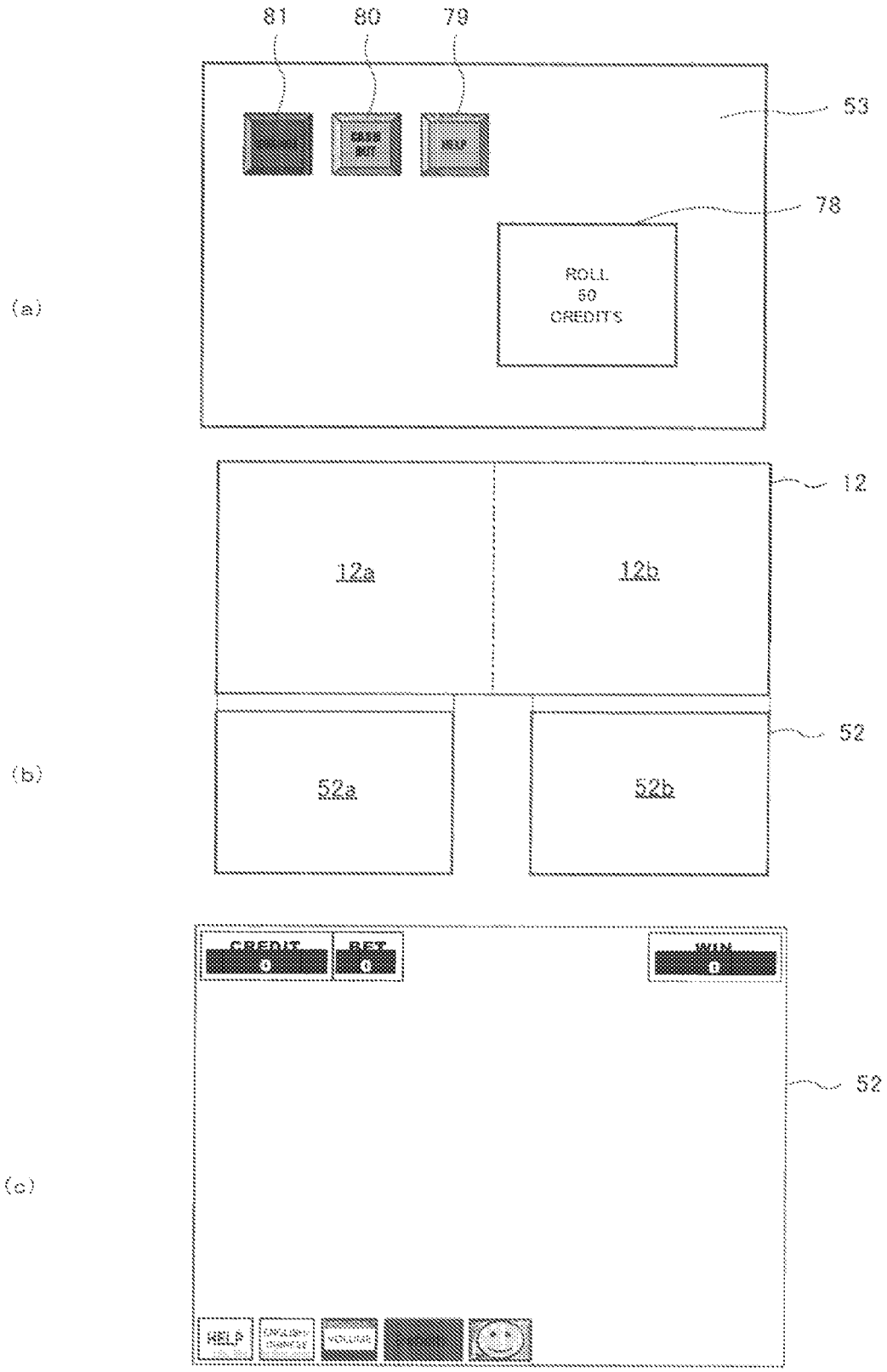
FIG. 2(*a*) is a front view schematically showing a control panel of the gaming machine shown in FIG. 1.

FIG. 2(*a*) is a front view schematically showing a control panel of the gaming machine shown in FIG. 1; FIG. 2(*b*) is a front view schematically showing a layout of a screen of an entire gaming machine; and FIG. 2(*c*) is a front view schematically showing a layout of a screen of a game terminal.

As shown in FIG. 2(*a*), on the control panel 53, a ROLL button 61, a HELP button 62, a CASHOUT button 63, and a CHANGE button 64 are installed. The ROLL button 61 is a button for inputting a command for casting dice (a command for determining the number of movements), and is compatible with a function as a BET button. That is, if the ROLL button 61 is operated by a player, a BET is established and a command for rolling dice is inputted.

The ROLL button 61 is provided in the game terminal 50, and is equivalent to a bet input portion at which a bet is placed in each unit game. In the present embodiment, the ROLL button 61 is a push button, and is configured to be directly (physically) operated by a player. The bet input portion is not limited to the push button, and may be a lever.

The present invention is not limited to this example, and in the gaming machine of the present invention, the ROLL button and the BET button may be provided separately. In this case, the command for determining the number of movements is configured to be input by an operation of the ROLL button after a BET input by the BET button.

The CASHOUT button 63 is equivalent to a liquidation command input portion at which a liquidation command is input by a player's operation.

As shown in FIG. 2(*b*), the gaming machine 1 is provided with one common display device 12 and a plurality of terminal display devices 52. Each of the terminal display devices 52 is provided with player game screens 52*a* and 52*b*. A screen of the common display device 12 is divided in a transverse direction into the same number of game terminals 50, and player top screens 12*a* and 12*b* are positioned on upper sides of the player game screens 52*a* and 52*b*. A 1P top screen 12*a* is located on the upper side of the 1P game screen 52*a*, and a 2P top screen 12*b* is located at the upper side of the 2P game screen 52*b*.

A common display device 12 displays a maps, a route, a character stop position, a goal, an object such as a dollar box, an object such as a community, a village, or a building, and a piece indicating a position of a character on the map.

On the terminal display device 52, credit, dice and BET information or the like of a player who plays a game at the game terminal 50 is displayed. One language in the terminal display device 52 can be switched into another. In the present embodiment, English can be switched into Chinese or vice versa. The languages in the common display device 12 can be set on the gaming facility side.

As shown in FIG. 2(*c*), on the upper side of the terminal display device 52, the number of credits, the number of bets, and the number of wins are displayed. On the lower side of the terminal display device 52, there are displayed: a HELP button which functions as the HELP button 62 in the same way;

an English/Chinese button for instructing switching between English and Chinese; a volume button for inputting a command for volume control; a Denomi button for instructing display of denomination; and a character icon indicating a character in selection. Each image displayed on the lower side of the terminal display device 52 can be operated by means of a touch panel 60.

<<<Internal Configuration of Common Portion of Gaming Machine>>>

Figure 3:
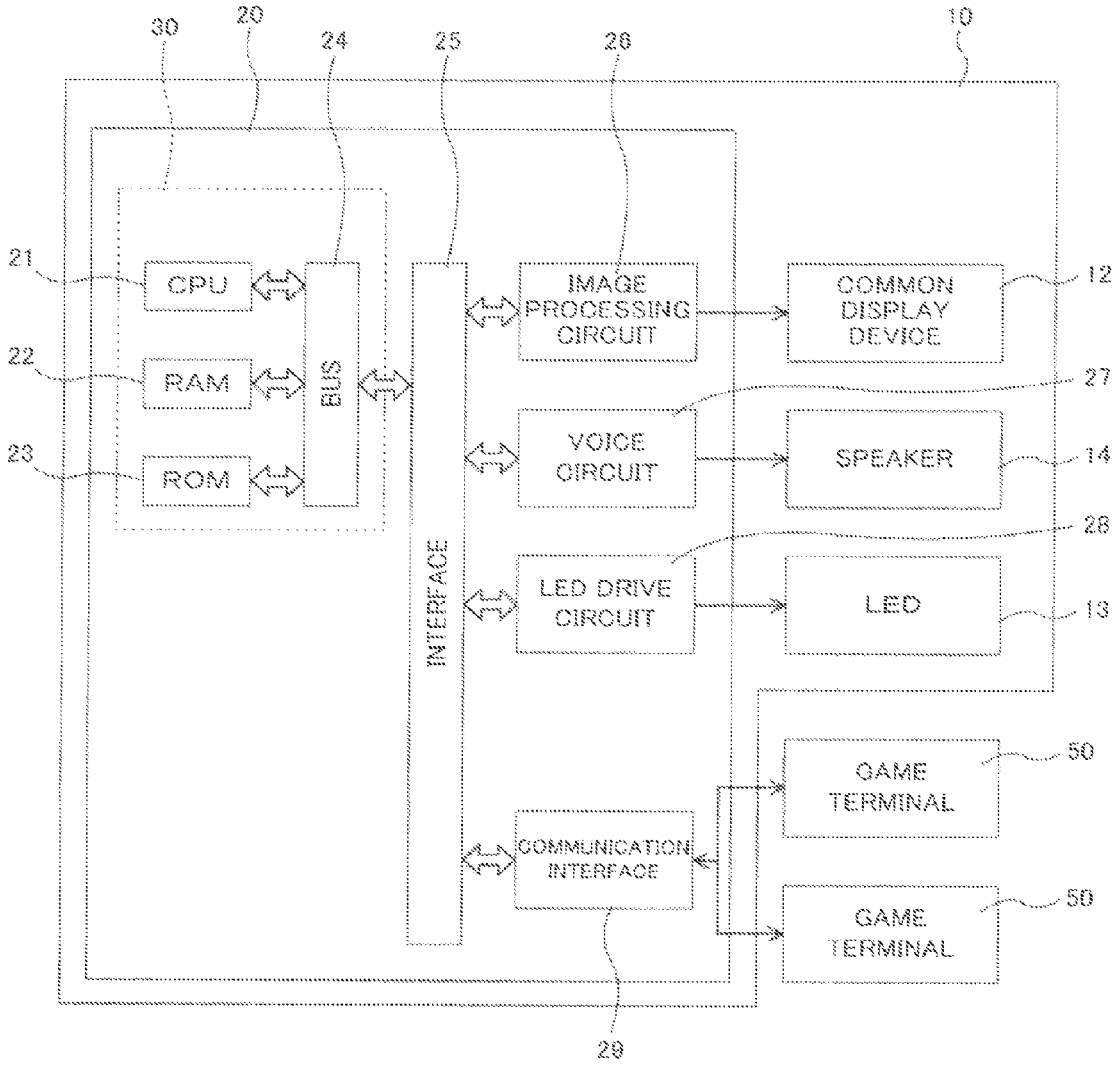
FIG. 3 is a block diagram schematically depicting an internal configuration of a common portion in the gaming machine shown in FIG. 1.

FIG. 3 is a block diagram schematically depicting an internal construction of the common portion in the gaming machine shown in FIG. 1.

A common portion 10 has a control portion 20. The control portion 20 has a microcomputer 30. The microcomputer 30 is basically comprised of: a CPU 21; a RAM 22; a ROM 23; and a bus 24 for transmitting or receiving data between them.

The ROM 23 stores: a variety of programs for performing processing required for controlling the gaming machines 1; a variety of table data; and a variety of image data or the like. The ROM 23 also stores a map determination table and a plurality of map data. The map determination table stores map identification information. By referring to the map determination table using the map identification information and then reading out the map data, a map can be displayed on the common display device 12.

The ROM 23 stores a character determination table and a plurality of types of character data. The character determination table stores character identification information. By referring to the character determination table using the character identification information and then reading out character image data, a variety of characters can be displayed on the common display device 12. The plurality of characters types are a player character, an enemy character, and a fellow character.

The ROM 23 stores the data such as features of each of the plurality of types of characters. The features are a variety of features that are capable of characterizing characters such as hit points of the characters.

The map data is equivalent to "route data" or "map data" in the present invention. The RAM 22 or the ROM 23 is equivalent to a "memory".

The RAM 22 is a memory that temporarily stores a variety of data computed by the CPU 21.

The CPU 21 is connected via an interface 25 to an image processing circuit 26, a voice circuit 27, an LED drive circuit 28, and a communication interface 29.

The common display device 12 is connected to the image processing circuit 26, the speaker 14 is connected to the voice circuit 27, and an LED 13 is connected to the LED drive circuit 28. Two game terminals 50 are connected to the communication interface 29.

The CPU 21 controls a game based on the programs stored in the ROM 23 and a variety of signals received from the game terminals 50, displays an image on the common display device 12 in accordance with the progress of a game, outputs a sound from the speaker 14, and lights the LED 13. In addition, the CPU 21 transmits a variety of signals to the game terminals 50 in accordance with the progress of a game.

In addition, a server (not shown) is connected to a communication interface 29. The server is a hall server that is installed in a gaming facility such as casino. A unique identification number is assigned to each of the gaming machines 1, and the server is configured to identify a source of data that is sent from at least one of the gaming machines 1 in accordance with the identification number. In a case where data is transmitted from the server to at least one of the gaming machines 1 as well, a transmission destination is specified using the identification number.

A player tracking system (PTS) 84 to be described later can communicate with the server via the communication interface 29. A unique identification number is assigned to each of the game terminals 50. The server and the PTS 84 can communicate with each other by using identification information on the game terminals 50 as well as identification information on the gaming machines 1.

The common display device 12 is equivalent to a "common display" or a "display". The control portion 20 or the microcomputer 30 is equivalent to a "controller of one gaming machine" or a "controller of another gaming machine". The gaming machine 1 is equivalent to "one gaming machine" or "another gaming machine".

<<<Game Terminal of Gaming Machine>>>

Figure 4:
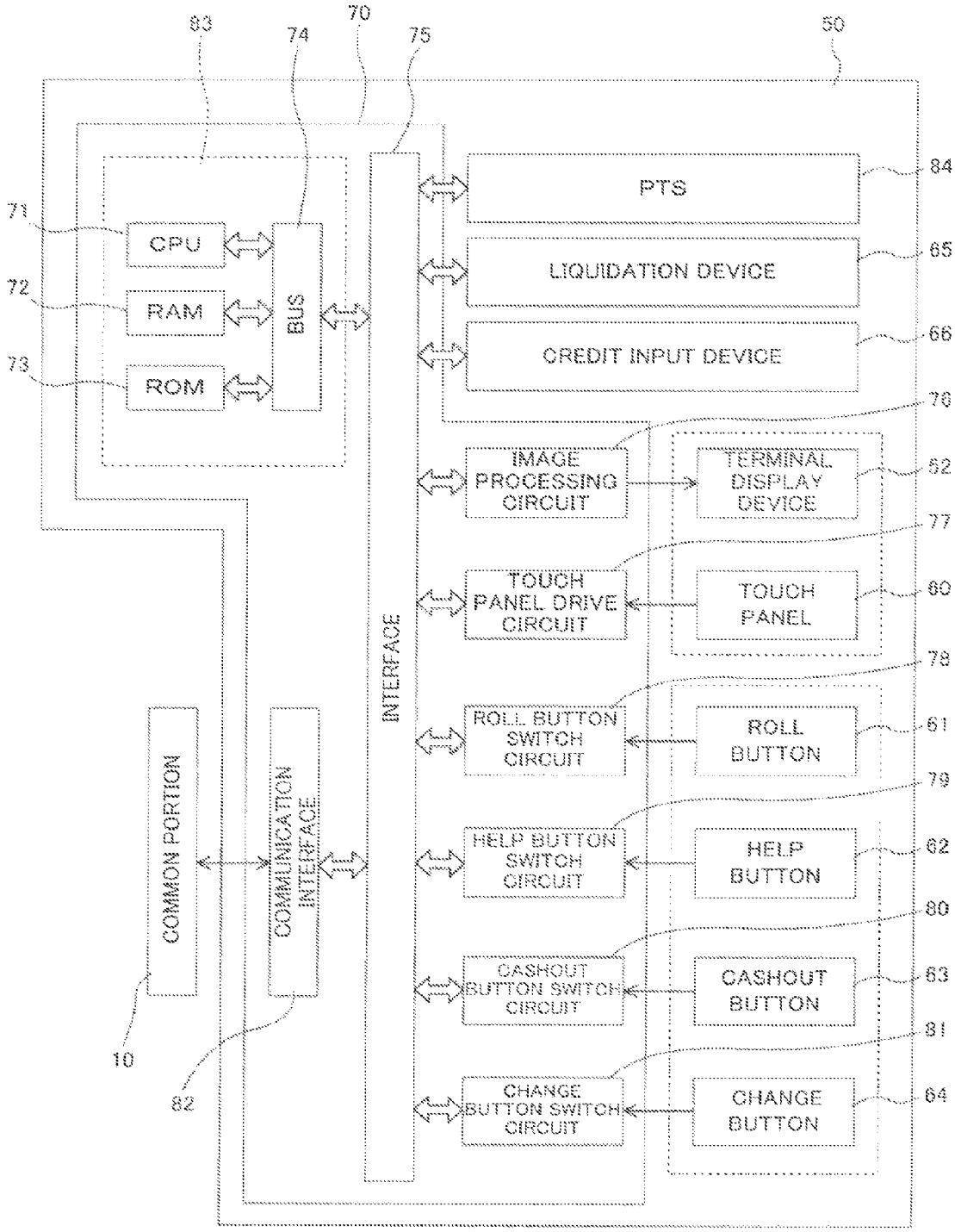
FIG. 4 is a block diagram schematically depicting an internal configuration of the game terminal in the gaming machine shown in FIG. 1.

FIG. 4 is a block diagram schematically depicting an internal construction of the game terminal in the gaming machine shown in FIG. 1.

A control portion 70 included in the game terminal 50 is basically configured while a microcomputer 83 made of a CPU 71, a RAM 72, a ROM 73, and a bus 74 for transferring data between them is employed as a core.

The ROM 73 stores a variety of programs for performing processing that is required to control the game terminal 50, data, image data or the like.

The ROM 73 stores a character determination table and a plurality of types of character data. The character determination table stores character identification information. By referring to the character determination table using the character identification information and then reading out character image data, a variety of characters can be displayed on the terminal display device 52.

The RAM 72 temporarily stores the number of credits accumulated in the game terminal 50 or a variety of data computed by the CPU 71. The RAM 72 is equivalent to a number-of-credits storage portion that stores the number of credits of a player for each game terminal 50.

The RAM 72 or the ROM 73 is equivalent to a "memory".

The CPU 71 is connected via an interface 75, to a liquidation device 65, a credit input device 66, an image processing circuit 76, a touch panel drive circuit 77, a ROLL button switch circuit 78, a HELP button switch circuit 79, a CASHOUT button switch circuit 80, a CHANGE button switch circuit 81, and a communication interface 82.

The terminal display device 52 is connected to the image processing circuit 76, the touch panel 60 is connected to the touch panel drive circuit 77, the ROLL button 61 is connected to the ROLL button switch circuit 78, the HELP button 62 is connected to the HELP button switch circuit 79, the CASHOUT button 63 is connected to the CASHOUT button switch circuit 80, and the CHANGE button 64 is connected to the CHANGE button switch circuit 81. The communication interface 82 is connected to the common portion 10.

These touch panel 60, ROLL button 61, HELP button 62, CASHOUT button 63, CHANGE button 64 or the like is equivalent to an "operating device".

In the present embodiment, the ROLL button switch circuit 78 is provided with a pressure sensor (not shown), and is configured so as to be able to sense strength of a player's operation for the ROLL button 61. The pressure sensor is provided with: a pressure sensitive resistor in which a resistance value changes according to an area of contact with an object; and an elastic member that is disposed to be spaced from the pressure sensitive resistor at predetermined intervals and that moves toward the above pressure sensitive resistor by pressing the ROLL button 61. If the ROLL button 61 is depressed, the pressure sensitive resistor and the elastic member come into contact with each other, if the operation strength of the ROLL button 61 becomes strong, the elastic member is deformed and then an area of contact with the pressure sensitive resistor increases. Concurrently, a resistance value of the pressure sensitive resistor decreases. Therefore, a voltage value of an analog signal that is output from the pressure sensor varies. The operation strength of the player for the ROLL button 61 can be detected by determining which of the predetermined operation strengths "strong", "middle", and "gentle" the voltage value comes under. The pressure sensor is not limited to this example, and a conventionally publicly known pressure sensor can be employed. The pressure sensor is provided as one example of an operation strength detecting portion in the present invention.

The liquidation device 65 is a device that is provided inside of the game terminal 50 and that performs liquidation processing based on a control signal output from the CPU 71. The liquidation processing is not limited in particular, and can include payout of gaming media such as coins or chips, output of receipt, liquidation of cards such as credit cards or the like. The liquidation device 65 may be configured so that plural kinds of liquidation processes are possible or maybe configured so that only one kind of liquidation process can be executed. The liquidation device 65 is equivalent to a liquidation processing portion that performs liquidation processing.

The credit input device 66 is a device that is provided inside the game terminal 50 and that accepts input of gaming media such as coins or chips, currencies such as bills or money, or cards such as credit cards or like, and an input amount is stored in the RAM 52 with a predetermined amount being one credit. The credit input device 66 is equivalent to a credit input portion that is provided in the game terminal 50.

In the present embodiment, the CPU 21 or 71 executes a variety of processes relating to a game (for example, the processes shown in FIG. 5 to FIG. 10), and a result of the processing are stored in each of the RAMs 22 and 72. Data stored in the RAMs 22 and 72 or part of the data is synchronized with a predetermined timing. That is, while, in the present embodiment, each of the control portion 20 (the CPU 21) and the control portion 70 (the CPU 71) performs processing according to the progress of a game, the present invention is not limited in particular as to which control portion performs which processing. In addition, in the present invention, the control portion does not need to be provided in a respective one of the common portion and the game terminal, and the control portion may be provided in the common portion or the game terminal only.

<Player Tracking System (PTS)>

In addition, it is preferable to provide a player tracking system (hereinafter, referred to as a PTS) 84 in a game terminal 50. The PTS 84 is a device that receives a variety of information transmitted from a server (not shown) and then provides the received information to a player.

At a front face part of the PTS 84, a liquid crystal display (not shown), a card slot (not shown), and a player identifying portion (not shown) or the like are provided.

The liquid crystal display displays a variety of information that is received from the server. The card slot is an opening for inserting and removing an IC card. The player identifying portion is configured to detect a player who plays a game in front of the game terminal 50.

In the PTS 84, an IC card R/W (reader/writer) is provided. The IC card R/W reads data from an IC card that carried into the PTS 84 and then writes data into the IC card. A controller of the PTS 84 is configured to control the IC card R/W, the liquid crystal display, and the player identifying portion or the like, and the controller of the PTS 84 has a CPU, a ROM, and a RAM.

The IC card R/W reads data from an IC card and writes data into the IC card by means of an RFID (Radio Frequency Identification). The IC card R/W reads credit information stored in the IC card that is inserted through the card slot in a noncontact manner or writes a credit that is awarded to a player according to a result of a game into the IC card in a noncontact manner.

As described above, amount-of-money information can be written in an IC card. In addition to writing the amount-of-money information, the amount-of-money information can also be read out from the IC card. The amount-of-money information is read out and written by means of the IC card R/W.

Further, an IC card also stores identification information such as serial numbers for identifying the IC card (hereinafter, referred to as a card ID). It is preferable that the card ID be stored in the IC card in advance so as to enable readout only and to disable rewriting. The card ID is adapted to identify an IC card, and can also be employed as information for identifying a player in a gaming facility. The server stores the player's personal information or history information on games that have been played up to now, in accordance with a card ID read out from an IC card.

As described above, the PTS 84 communicates with the server via a communication interface 29 of a common portion 10. The PTS 84 may communicate with the server via a communication interface 82 of a game terminal 50. As described above, a unique identification number is assigned to each of the game terminals 50. The server and the PTS 84 can communicate with each other by using the identification information on the game terminal 50. By doing this, the PTS 84 can communicate with the server without a need to interpose the common portion 10.

A terminal display device 52 is equivalent to a "display". A control portion 70 or a microcomputer 83 is equivalent to a "controller of one gaming machine" or a "controller of another gaming machine". A game terminal 50 is equivalent to "one gaming machine" or "another gaming machine".

<<<Game Control Processing>>>

<<<Role playing game processing>>>

Figure 5:
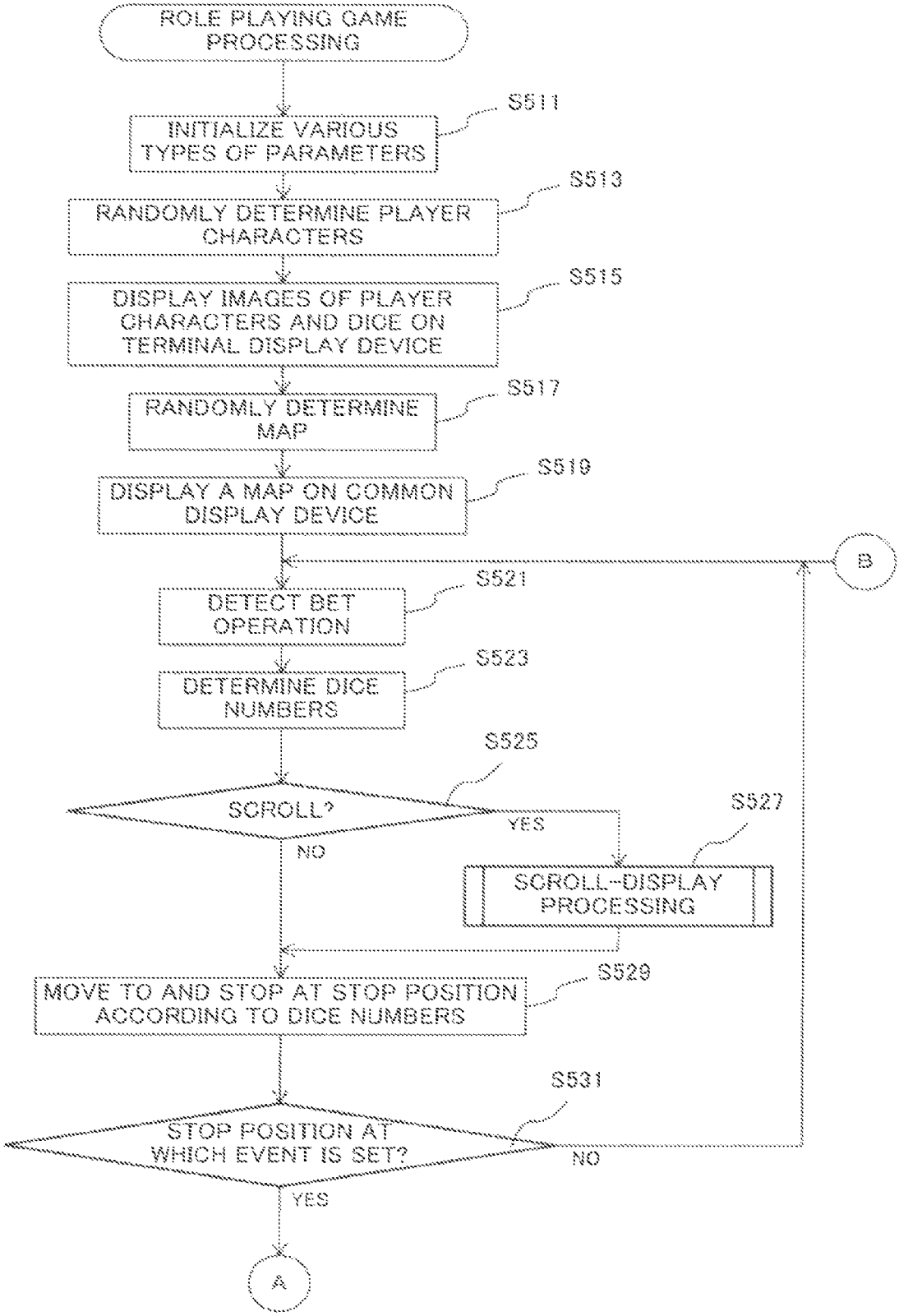
FIG. 5 is a flowchart showing a subroutine of roll playing game processing.
Figure 6:
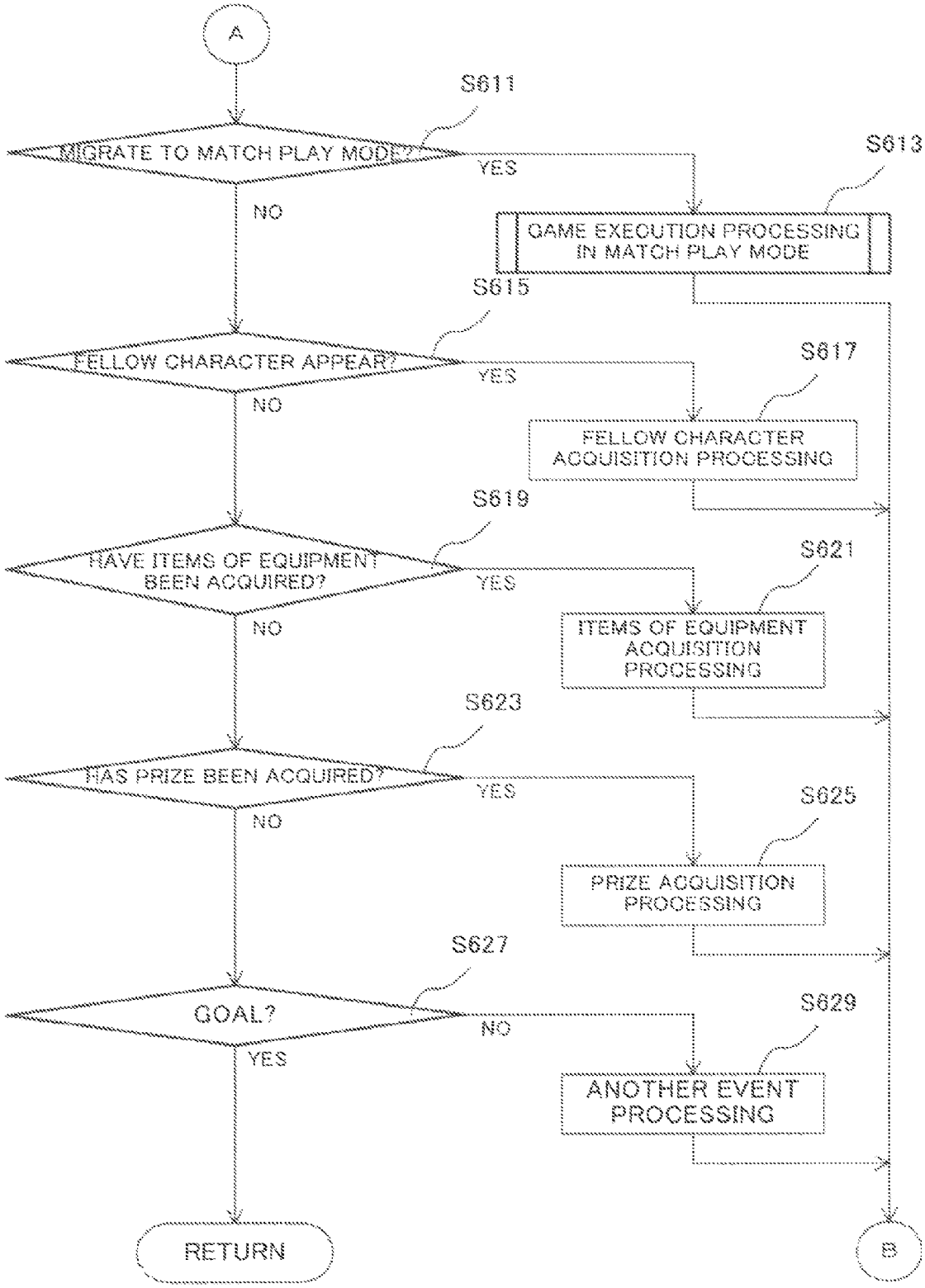
FIG. 6 is a flowchart showing a subroutine of the role playing game processing.

FIG. 5 and FIG. 6 are flowcharts each showing a subroutine of role playing game processing. This processing is processing in the game terminal 50. A predetermined command is transmitted from the game terminal 50 to the common portion 10 via the communication interface 29, whereby role playing game processing can be executed in the common portion 10 as well. The flowcharts of FIG. 5 and FIG. 6 showed the processing in the game terminal 50 and the processing in the common portion 10 in a coexisting manner.

First, a CPU 71 initializes a variety of parameter values (step S511). Initialization processing can be performed in the game terminal 50. Concurrently with the processing in step S511, an initialization command may be transmitted from the game terminal 50 to the common portion 10 via the communication interface 29. By doing this, initialization processing can be performed in both of the game terminal 50 and the common portion 10.

Next, the CPU 71 randomly determines player characters (step S513). The player characters are determined by means of lottery, for example. The player characters are characters that can reflect an operation of a ROLL button 61 by a player. A plurality of types of the player characters are defined in advance. The game terminal 50 transmits identification information for identifying types of the player characters to the common portion 10. By using the identification information that is transmitted from the game terminal 50, the common portion 10 can read out image data on the player characters from the ROM 23 and then display the player characters on the common display device 12.

The CPU 71 then displays an image of the player characters that are determined in accordance with the processing in step S513 and a dice image on the terminal display device 52 (step S515).

The CPU 71 then randomly determines a map (step S517). The step S517 is a process for selecting one map from among a plurality of maps, and identification information on such selected one map is determined.

The CPU 71 then transmits identification information on one map selected, from the game terminal 50 to the common portion 10 via the communication interface 29 (step S519). A CPU 21 of the common portion 10 uses the identification information on one map selected, which is transmitted from the game terminal 50, to display the map on the common display device 12.

The CPU 71 then detects that a player has operated the ROLL button 61, i.e., that a player has made a BET operation (step S521).

The CPU 71 then randomly determines dice numbers (step S523). The dice numbers are determined by means of lottery, for example. Concurrently with the processing in step S523, the CPU 71 transmits the dice numbers that are determined in step S523 from the game terminal 50 to the common portion 10 via the communication interface 29.

The CPU 21 of the common portion 10 determines whether or not there is a need to scroll a map (step S525). This scroll is an enlarged scroll-display of displaying a map depth portion on the display in an enlarged manner. That is, when a player character moves toward a goal on the map, the player character gradually moves in the depth direction of the map. When the player character moves in the depth direction of the map, the routes, communities, and buildings or the like on the map are gradually reduced in size and are hardly visually recognized. Thus, when the player character has moved in the depth direction of the map by a predetermined distance, the depth portion of the map is displayed on the display in an enlarged manner. By the enlarged scroll-display, root or building can be easy to be watched. The determination in step S525 can be made based on a distance at which a character has moved or a position on the map or the like.

When determining that there is a need to scroll a map (YES), the CPU 21 of the common portion 10 executes scroll display processing shown in FIG. 9 to be described later (step S527).

When determining that there is no need to scroll a map (NO) or when executing the processing in step S527, the CPU 21 of the common portion 10 causes the common display device 12 to display the player character so as to move to and stop at a stop position according to the dice numbers that are transmitted from the game terminal 50 to the common portion 10.

The CPU 21 of the common portion 10 determines whether or not an event has been set at the stop position at which the player character has stopped (step S529). When determining that no event has been set at the stop position at which the player character has stopped (NO), the CPU 21 of the common portion 10 causes the routine to revert to step S521.

When determining that the event has been set at the stop position at which the player character has stopped (YES), the CPU 21 of the common portion 10 determines whether or not the set event falls into an event migrating to a match play mode (step S611).

When determining that the set event falls into the event migrating to the match play mode (YES), the CPU 21 of the common portion 10 invokes and executes game execution processing in the match play mode to be described later (step S613) and then causes the routine to revert to step S521.

When determining that the routine does not fall into an event migrating to a match play mode (NO), the CPU 21 of the common portion 10 determines whether or not the routine falls into an event causing a fellow character to appear (step S615).

When determining that the event falls into the event causing the fellow character to appear (YES), the CPU 21 of the control portion 10 causes the fellow character to appear (step S617) and then causes the routine to revert to step S521. Like the player character or enemy character, with a plurality of types of the fellow characters being predetermined, one fellow character may be randomly selected from among the plurality of types of the fellow characters by means of lottery or the like in accordance with the processing of step S617. A variety of data relating to the fellow characters are also stored in advance in the ROM 23. The fellow characters are non-player characters that cannot reflect a player operation.

When determining that the set event does not fall into an event causing a fellow character to appear (NO), the CPU 21 of the common portion 10 determines that the set event falls into an event causing items of equipment to be acquired (step S619).

When determining that the set event falls into the event causing items of equipment to be acquired (YES), the CPU 21 of the common portion 10 causes the items of equipment to appear (step S621) and then causes the routine to revert to step S521. The items of equipment are articles that a player character is allowed to have, and the common display device 12 displays an appearance of a player character wearing the acquired items of equipment.

When determining that the set event does not fall into the event causing items of equipment to be acquired (NO), the CPU 21 of the common portion 10 determines whether or not the set event falls into an event that is capable of acquiring a prize (step S623).

When determining that the set event falls into the event that is capable of acquiring a prize (YES), the CPU 21 of the common portion 10 causes the RAM 22 to store the acquired prize (step S625) and then causes the routine to revert to step S521.

Concurrently with the processing in step S625, by transmitting information indicating prizes from the common portion 10 to the game terminal 50, the acquired prize can be stored in the RAM 72 of the game terminal 50 as well.

When determining that the set event does not fall into the event that is capable of acquiring a prize (NO), the CPU 21 of the common portion 10 determines whether or not a goal has been reached (step S627).

When determining that the goal has not been reached (NO), the CPU 21 of the common portion 10 executes processing in another event (step S629) and then causes the routine to revert to step S521.

When determining that the goal has been reached (YES), the CPU 21 of the common portion 10 completes this subroutine.

<<<Game Processing in Match Play Mode>>>

Figure 7:
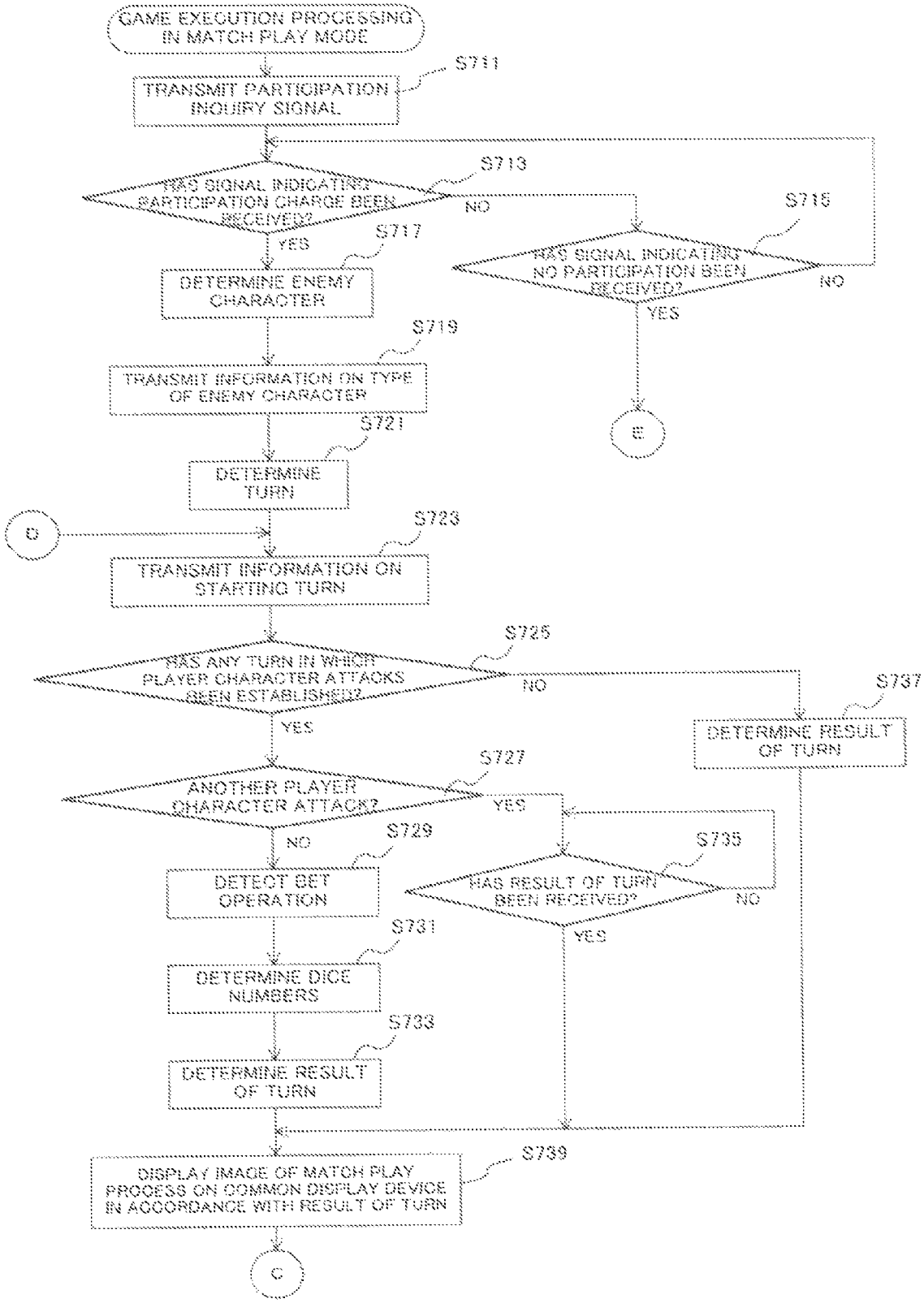
FIG. 7 is a flowchart showing a subroutine of game processing in a match play mode.
Figure 8:
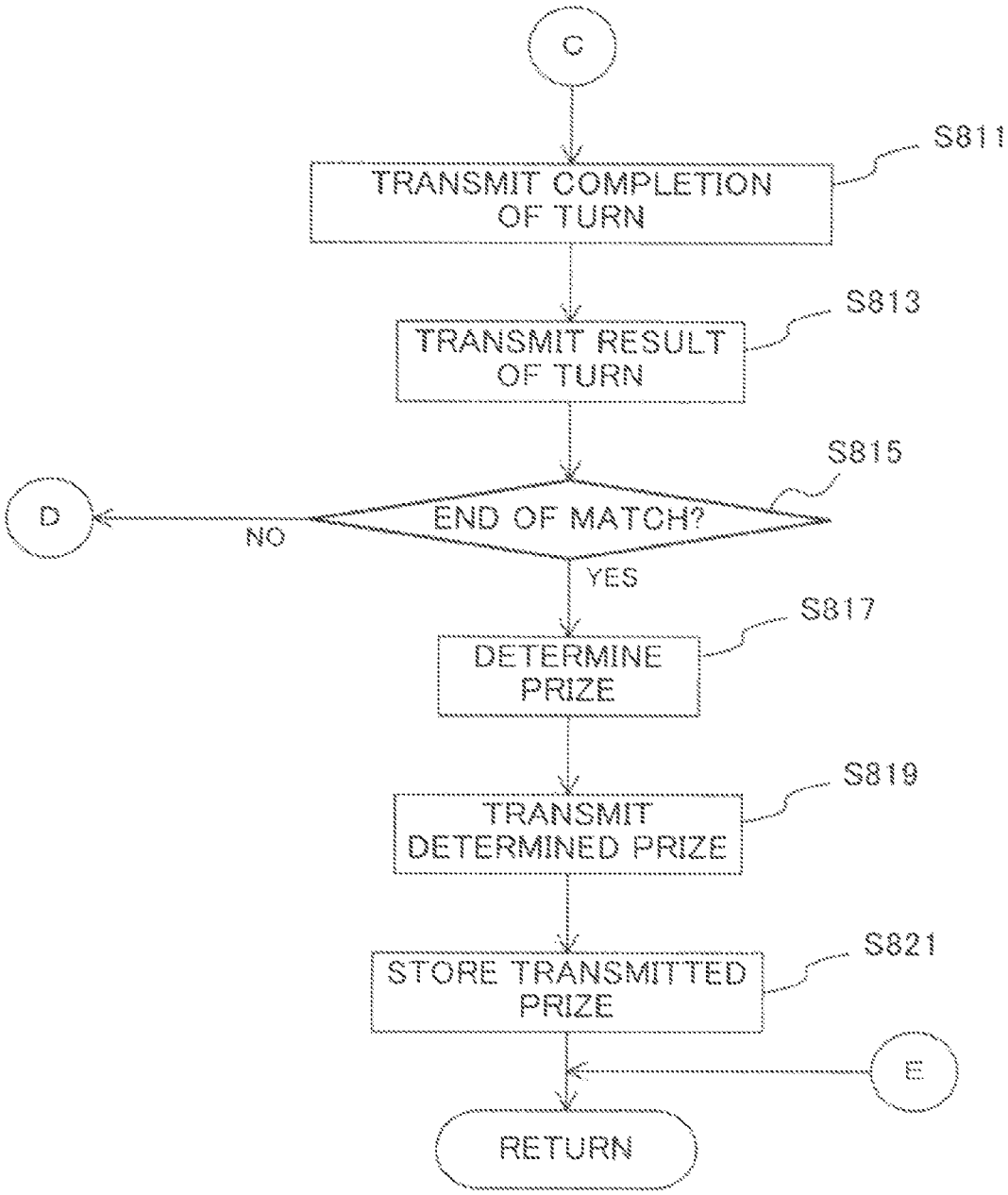
FIG. 8 is a flowchart showing a subroutine of the game processing in the match play mode.

FIG. 7 and FIG. 8 are flowcharts each showing a subroutine of game processing in a match play mode. While this processing is directed to processing in the game terminal 50, a predetermined command is transmitted from the game terminal 50 to the common portion 10 via the communication interface 29, whereby the game processing in the match play mode can be executed in the common portion 10 as well. The flowcharts of FIG. 7 and FIG. 8 show the processing in game terminal 50 and the processing in the common portion 10 in a coexisting manner.

A game in a match play mode is a game adapted to play a match between a player who plays a game at one game terminal 50 and a player who plays a game at another game terminal 50. Therefore, a variety of control signals for advancing the game of the match play mode is transmitted from one game terminal 50 to the common portion 10 and then the transmitted signals are transmitted from the common portion 10 to another game terminal 50. Similarly, the control signals that are transmitted from another game terminal 50 to the common portion 10 are transmitted from the common portion 10 to one game terminal 50. In this way, one game terminal 50 and another game terminal 50 communicate with each other via the common portion 10 to be able to advance the game of the match play mode. In the game of the match play mode, for the sake of clarity, a description will be given while one game terminal 50 and another game terminal 50 are discriminated from each other.

First, a CPU 71 of one game terminal 50 transmits to another game terminal 50 a participation inquiry signal indicating inquiry of whether or not to participate in a game of a match play mode (step S711). As described above, the participation inquiry signal is transmitted from one game terminal 50 to another game terminal 50 via the common portion 10.

Next, the CPU 71 of one game terminal 50 determines whether or not a signal indicating a participation charge, transmitted from another game terminal 50 (step S713), has been received. The participation charge is a charge required for a player who plays a game at another game terminal 50 to participate in a game of a match play mode that has occurred at one game terminal 50. The signal indicating the participation charge is also transmitted from another game terminal 50 to one game terminal 50 via the common portion 10.

When determining that the signal indicating the participation charge, transmitted from another game terminal 50, has not been received (NO), the CPU 71 of one game terminal 50 determines whether or not a signal indicating no participation has been received (step S715). The signal indicating no participation is a signal to be transmitted from another game terminal 50 to when a player who plays a game at another game terminal 50 has desired not to participate in a game in a match play mode. The signal indicating no participation is also transmitted from another game terminal 50 to one game terminal 50 via the common portion 10.

When determining that the signal indicating no participation has not been received (NO), the CPU 71 of one game terminal 50 causes the routine to revert to step S713. When determining that the signal indicating no participation has been received (YES), the CPU 71 of one game terminal 50 completes this subroutine.

When, in the determination processing of step S713, it is determined that the signal indicating the participation charge, transmitted from another game terminal 50, has been received (YES), an enemy character is randomly determined (step S717). The player characters are determined by means of lottery, for example. The enemy character is a character that plays a match with the player characters in the game of the match play mode.

The enemy character may be determined in accordance with the strength and defensing power or the like of a player character in place of being randomly determined. By receiving the signal indicating a participation charge from another game terminal 50 and information indicating the player character in another game terminal 50, the enemy character can be determined from the strengths and defensing powers or the like of both of a type of the player character in one game terminal 50 and a type of the player character in another game terminal 50.

Next, the CPU 71 of one game terminal 50 transmits information indicating the determined type of enemy character to another game terminal 50 (step S719). The information indicating the determined type of enemy character is also transmitted from one game terminal 50 to another game terminal 50 via the common portion 10.

The CPU 71 of one game terminal 50 determines a turn of a match play (step S721). For example, there are four turns (1) to (4), i.e., a turn (1) in which one player character attacks an enemy character; a turn (2) in which another player character attacks an enemy character; a turn (3) in which an enemy character attacks one player character; and a turn (4) in which an enemy character attaches another player character. In addition, the turn (3) and the turn (4) are combined with each other to form a turn (3') in which an enemy character attacks one player character and another player character at the same time, whereby three turns (1), (2), and (3') may be formed. By doing this, a match play can be advanced speedily. In addition, there may be formed a turn in which one player character and another player character attack an enemy character at the same time or the like.

In a case where a fellow character is acquired in the processing of step S617 of FIG. 6, there can be included a turn in which the fellow character and the enemy character play a match with each other. In any case, there may be included at least a turn in which a player character and an enemy character play a match with each other. The game of the match play mode is played by repeating these turns until a match play completion condition has been met.

Next, the CPU 71 of one game terminal 50 transmits information relating to a starting turn to another game terminal 50 (step S723). For example, this CPU 71 transmits to another game terminal 50 the fact that the starting turn is a "turn in which one player character attacks an enemy character". The information relating to the starting turn is also transmitted from one game terminal 50 to another game terminal 50 via the common portion 10.

The CPU 71 of one game terminal 50 then determines whether or not a turn in which a player character attacks is established (step S725). That is, this CPU 71 determines whether or not at least a turn in which "one player character" or "another player character" attacks an enemy character is established.

When determining that the turn in which the player character attacks is established (YES), the CPU 71 of one game terminal 50 determines whether or not a turn in which another player character attacks an enemy character is established (step S727).

When determining that a turn in which another player character attacks the enemy character is not established (NO), i.e., in a case where one player character attacks the enemy character, the CPU 71 of one game terminal 50 detects that a player has operated the ROLL button 61, i.e., that a player has made a BET operation (step S729).

Next, the CPU 71 of one game terminal 50 randomly determines dice numbers (step S731). The dice numbers are determined by means of lottery processing, for example.

Attacking types of one player character are determined by the dice numbers determined in accordance with the processing of step S731. For example, the dice number is 1, the attacking type is determined to be a punch, or alternatively, when the dice number is 6, the attacking type is determined to be a special move. In addition, the attacking power of one player character is determined by the amount of money that is betted in accordance with the processing of step S729. Even if the attacking power of one player character is strengthened by betting more amount of money, severe damage is not always imparted to an enemy character, depending on the defensing power or defensing move of the enemy character.

Next, the CPU 71 of one game terminal 50 determines a result of the turn, based on the attacking type and attacking power of one player character (step S733). This processing is processing of computing the values of the features of the respective characters, depending on the attacking type and attacking power of one player character and the defensing type and defensing power of the enemy character. For example, a hit point and an experience value or the like are computed and then the computations are stored in the RAM 73.

The CPU 71 of one game terminal 50 randomly determines the defensing type and defensing power of an enemy character. In addition, the defensing type and defensing power of the enemy character may be determined in accordance with the attacking type and attacking power of one character.

Next, the CPU 71 of one game terminal 50 transmits a result of the turn that is determined in the processing of step S733 to the common portion 10. The CPU 21 of the common portion 10 refers to the result of the turn that is transmitted from one game terminal 50, selects an image indicating the progress of a match play, and displays the image indicating the progress of the match play on the common display device 12 (step S739). The image data indicating the progress of the match play is stored in advance in the ROM 23 of the common portion 10, and the stored image data is selected in accordance with the result of the turn so that the selected image data can be read out from the ROM 23.

When determining that a turn in which another player character attacks an enemy character is established (YES) in the determination processing of step S727 described above, i.e., in a case where another player character attacks an enemy character, the CPU 71 of one game terminal 50 determines whether or not the result of the turn that is transmitted from another game terminal 50 has been received (step S735).

In this case, processing similar to those in steps S729 to S733 described above is executed in another game terminal 50 at which another player plays a game. The result of the turn that is determined in another game terminal 50 is transmitted from another game terminal 50 to one game terminal 50. The processing of step S735 is processing of determining whether or not the result of the turn has been received. The result of the turn is also transmitted from another game terminal 50 to one game terminal 50 via the common portion 10.

When receiving the result of the turn that is transmitted from another game terminal 50, the CPU 71 of one game terminal 50 causes the routine to proceed to step S739 described above and then transmits the result of the turn to the common portion 10. In this way, an image indicating the progress of a match play is displayed on the common display device 12.

When determining that the turn in which the player character attacks is not established in the determination processing of step S725 described above (NO), i.e., in a case where the turn in which the enemy character attacks one player character or another player character is established, the CPU 71 of one game terminal 50 determines a result of the turn (step S737). In this case, the defensing type or defensing power of one player character or another player character is randomly determined, and the attacking type or attacking power of the enemy character is randomly determined. Based on these determinations, as in the processing of step S733, the values of the features of the respective characters are computed and then stored in the RAM 73. For example, a hit point and an experience value or the like are computed and then the computations are stored in the RAM 73.

After executing the processing of step S739, the CPU 71 of one game terminal 50 transmits the fact that the turn has completed to another game terminal 50 (step S811). This fact is also transmitted from one game terminal 50 to another game terminal 50 via the common portion 10.

Next, the CPU 71 of one game terminal 50 transmits the result of the turn that is determined in the processing of step S733 to another game terminal 50 (step S813). This result is also transmitted from one game terminal 50 to another game terminal 50 via the common portion 10. Doing this enables the result of the turn in one game terminal 50 to be identical to that in another game terminal 50.

The CPU 71 of one game terminal 50 then determines whether or not a match play has completed (step S815). For example, this CPU 71 determines whether or not a value of a hit point of any character has been set to 0. This determination may be made based on the values of other features indicating the features of such any character.

When determining that the match has not completed (NO), the CPU 71 of one game terminal 50 causes the routine to revert to step S723.

When determining that the match play has completed (YES), the CPU 71 of one game terminal 50 determines a prize to be awarded to one player and a prize to be awarded to another player (step S817). It is preferable that these prizes be determined in accordance with a degree of contribution in a game of a match play mode. For example, during the game of the match play mode, a dividing rate of prize is determined in accordance with a ratio between a cumulative value that is obtained when one player character has decreased the number of hit points of an enemy character and a cumulative value that is obtained when another player character has decreased the number of hit points of the enemy character. More prizes can be awarded to a player of a player character having decreased the number of hit points of the enemy character more remarkably.

The CPU 71 of one game terminal 50 transmits the determined prize to another game terminal 50 (step S819). One game terminal 50 awards the prize to another player in accordance with the transmitted prize.

The CPU 71 of one game terminal 50 stores the determined prize in the RAM 72 (step S821) and then completes this subroutine.

Figure 9:
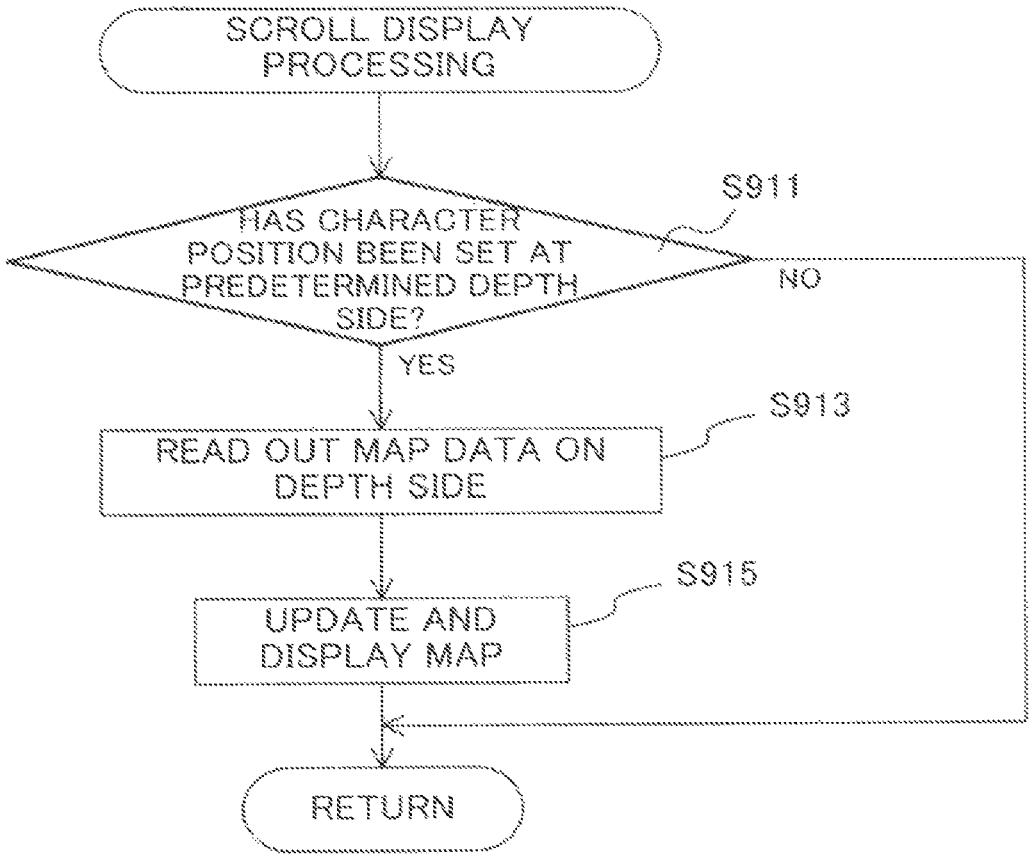
FIG. 9 is a subroutine showing a subroutine of scroll-display processing.

FIG. 9 is a subroutine indicating a subroutine of scroll-display processing that is executed in the processing of step S527 in FIG. 5. This processing is processing that the CPU 21 of the common portion 10 executes in response to a command from the game terminal 50.

First, the CPU 21 of the common portion 10 determines whether or not all of the characters have been set at predetermined depth side positions on a map (step S911). The character positions include a position of a player character, a position of an enemy character, and a position of a fellow character. The determination processing of step S911 is processing of determining whether or not all of the characters displayed on the map have been set at the predetermined depth side positions. Doing this enables all of the characters to be displayed in an enlarged manner on the map.

When determining that all of the characters have not been positioned at the predetermined depth side position (NO), the CPU 21 of the common portion 10 completes this subroutine immediately.

When determining that all of the characters have been positioned at the predetermined depth side position (YES), the CPU 21 of the common portion 10 reads out map data on the depth side from the ROM 23 (step S913).

The CPU 21 of the common portion 10 displays the map on the depth side on the common display device 12 by using the map data that is read out from the ROM 23 (step S915) and then completes this subroutine.

By doing this, when a variety of characters move from a front side of the map toward a depth at which a goal is set, a route or a geographical feature of a region at the depth side can be displayed on the display in an enlarged manner as the characters move to the depth side, and enlarged scroll-display can be provided.

Figure 11A:
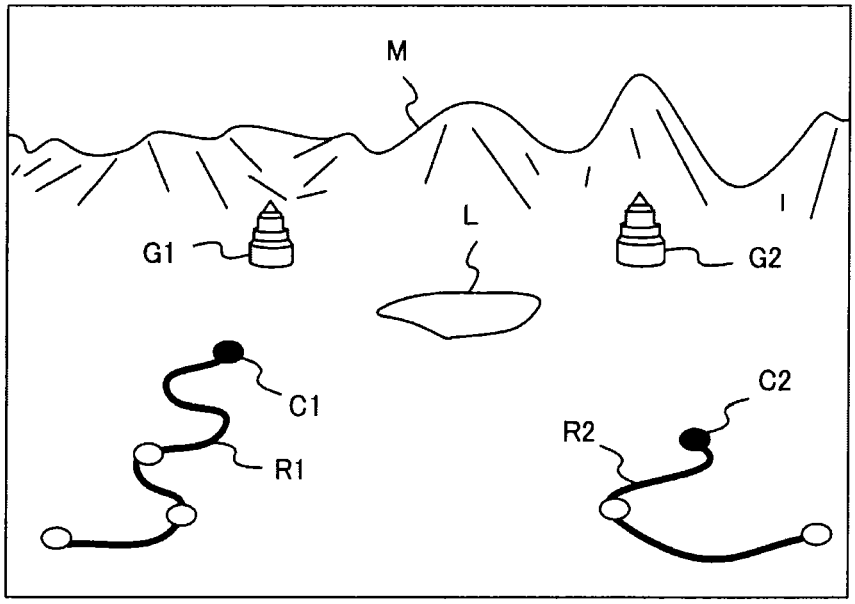
FIGS. 11A and 11B are views showing an example of a map that is displayed on a common display device 12.
Figure 11B:
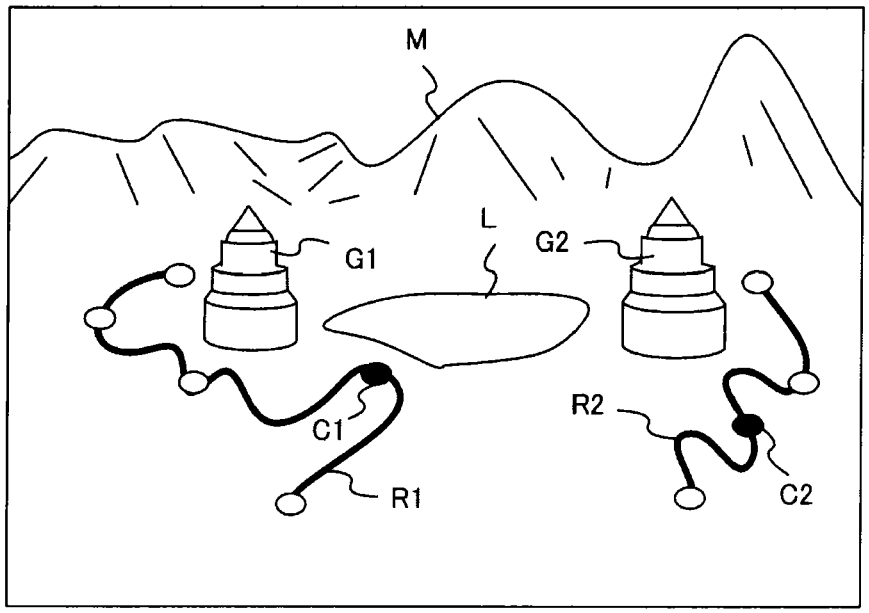

For example, examples shown in FIG. 11A and FIG. 11B are views showing an example of a map that is displayed on the common display device 12. A first goal G1 and a second goal G2 are positioned in front side of a mountain M on the depth side of the map. A lake L is situated between the first goal G1 and the second goal G2.

A first character C1 moves from the front side of the map toward the first goal G1 along a first route R1. A black circle mark on the first route R1 indicates a position of the first character C1. Similarly, a second character C2 moves from the front side of the map toward the second goal G2 along a second route R2. A black circle mark on the second route R2 indicates a position of the second character C2. A white circle mark indicates a stop position at which a character can stop.

In FIG. 11A, the first character C1 and the second character C2 are positioned on a front side on a map. The first character C1 and the second character C2 move to the depth side as a game advances. FIG. 11B shows an example of displaying the depth side of the map in an enlarged manner. When the first character C1 and the second character C2 have moved to the depth side, the route R1 or R2 and the stop position or the like are hardly visually recognized. As shown in FIG. 11B, the routes R1 and R2 that are positioned at the depth side of the map and other buildings or the like can be displayed to be easily visually recognized by displaying the depth side of the map in an enlarged manner.

The ROM 23 of the common portion 10 stores an interrelationship between character positions on a map and map data corresponding to the positions. The map data corresponding to the character positions on the map is read out from the ROM 23, whereby a map suitable for the character positions can be displayed on the common display device 12.

<<<Game Processing of Match Play Mode in Another Game Terminal 50>>>

Figure 10:
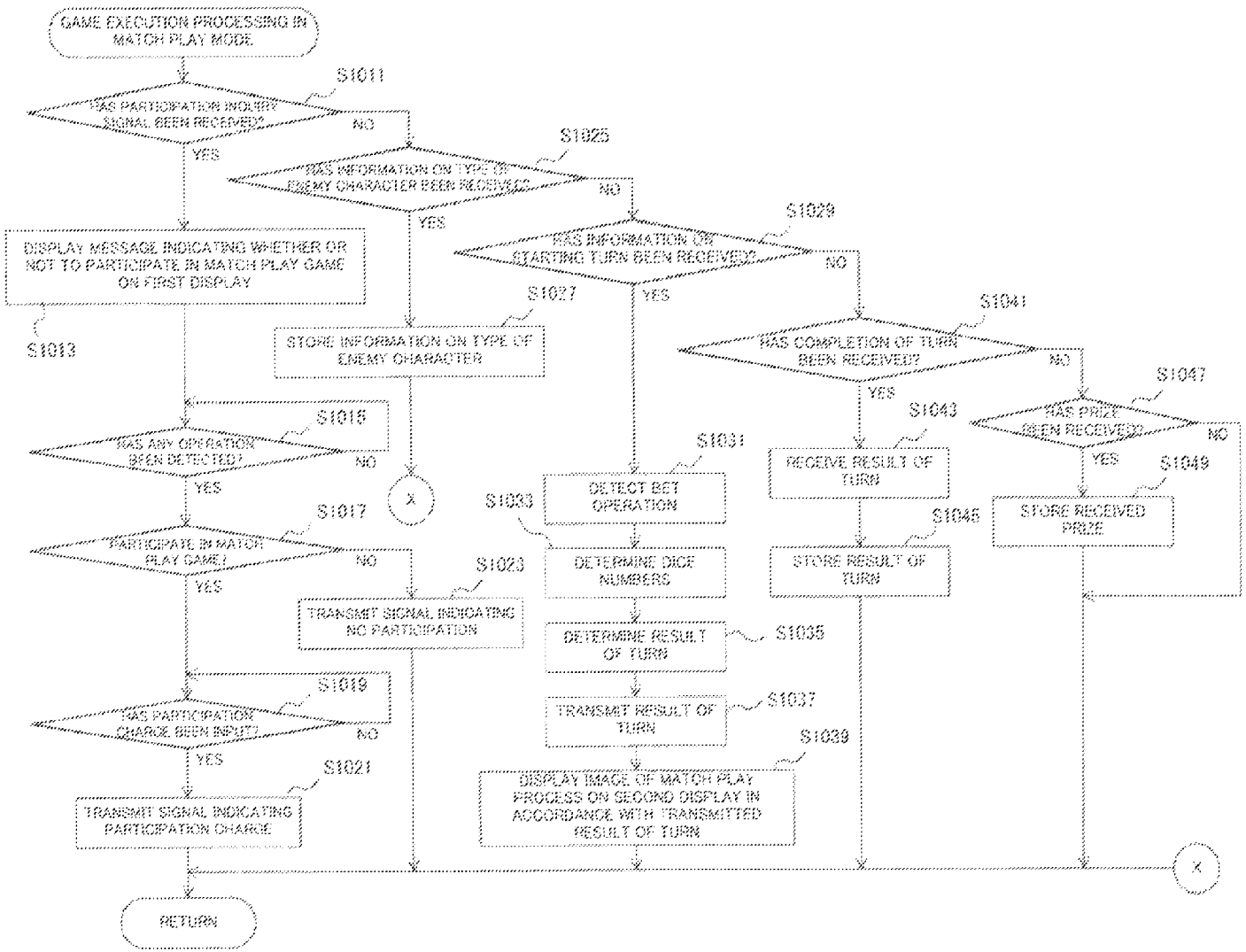
FIG. 10 is a flowchart showing a subroutine of game processing in a match play mode to be executed in another game terminal 50.

FIG. 10 is a flowchart showing a subroutine that is executed in another game terminal 50 when the routine has migrated to a game of a match play. This processing is invoked and executed by the CPU 71 of another game terminal 50, as triggered by the fact that a participation inquiry signal has been transmitted from one game terminal 50. While this subroutine is also mainly processing in another game terminal 50, a predetermined command is transmitted from another game terminal 50 to the common portion 10 via the communication interface 29, whereby game processing in a match play mode can be executed in the common portion 10 as well. The flowchart of FIG. 10 also shows the processing in another game terminal 50 and the processing in the common portion 10 in a coexisting manner.

First, the CPU 71 of another game terminal 50 determines whether or not a participation inquiry signal has been received (step S1011). This processing corresponds to the processing of step S711 in FIG. 7.

When determining that the participation inquiry signal has been received (YES), the CPU 71 of another game terminal 50 displays a message indicating whether or not to participate in a game of a match play mode on the terminal display device 52 of another game terminal 50 (step S1013).

Next, the CPU 71 of another game terminal 50 determines whether or not an operation of a touch panel 60 by a player has been detected (step S1015). When determining that the operation of the touch panel 60 by the player has not been detected (NO), the CPU 71 of another game terminal 50 causes the routine to revert to step S1015.

When determining that the operation of the touch panel 60 by the player has been detected (YES), the CPU 71 of another game terminal 50 determines whether or not an operation of participating in a game of a match play mode has been made (step S1017).

When determining that the operation of participating in the game of the match play mode has been made (YES), the CPU 71 of another game terminal 50 determines whether or not a participation charge has been input by an operation of a ROLL button 61 by a player (step S1019). When determining that the participation charge has not been input (NO), the CPU 71 of another game terminal 50 causes the routine to revert to step S1019.

When determining that the participation charge has been input (YES), the CPU 71 of another game terminal 50 transmits a signal indicating the participation charge to one game terminal 50 (step S1021) and then completes this subroutine. The processing of step S1021 corresponds to the processing of step S713 in FIG. 7.

When determining that the operation of participating in the game of the match play mode has not been made in the determination processing of step S1017 (NO), the CPU 71 of another game terminal 50 transmits a signal indicating no participation to defensing power or defensing move of the enemy character.

Next, the CPU 71 of another game terminal 50 determines a result of the turn, based on the attacking type and attacking power of another player character (step S1035). This processing is processing of computing the values of the features of the respective characters, depending on the attacking type and attacking power of another player character and the defensing type and defensing power of the enemy character. For example, a hit point and an experience value or the like are computed and then stored in the RAM 73.

The CPU 71 of another game terminal 50 randomly determines the defensing type and defensing power of an enemy character. In addition, the defensing type and defensing power of the enemy character may be determined in accordance with the attacking type and attacking power of another character.

Next, the CPU 71 of another game terminal 50 transmits a result of the turn that is determined in the processing of step S1037 to one game terminal 50 (step S1037). This processing corresponds to the processing of step S735 in FIG. 7.

Next, the CPU 71 of another game terminal 50 transmits the result of the turn that is determined in the processing of step S1037 to the common portion 10. The CPU 21 of the common portion 10 refers to the result of the turn that is transmitted from another game terminal 50, selects an image indicating the progress of a match play, and displays the image indicating the progress of the match play on the common display device 12 (step S1039). The image data indicating the progress of the match play is stored in advance in the ROM 23 of the common portion 10, and the stored image data is selected in accordance with the result of the turn so that the selected image data can be read out from the ROM 23.

When determining that the information on the starting turn has not been received in the determination processing of step S1029 (NO), the CPU 71 of another game terminal 50 determines whether or not the completion of the turn has been received (step S1041). This processing corresponds to step S811 of FIG. 8.

When determining that the information on the starting turn has been received (YES), the CPU 71 of another game terminal 50 receives a result of the turn (step S1043), causes the RAM 72 of another game terminal 50 to store the result of the turn (step S1045), and then, completes this subroutine.

When determining that the completion of the turn has not been receive (NO), the CPU 71 of another game terminal 50 judges whether or not a prime has been received (step S1047). This processing corresponds to step S819 of FIG. 8.

When determining that the prize has been received (YES), the CPU 71 of another game terminal 50 causes the RAM 72 of another game terminal 50 to store the prize (step S1049) and then completes this subroutine.

When determining that the prize has not been received (NO), the CPU 71 of another game terminal 50 completes this subroutine immediately.

What is claimed is:

1. A gaming machine comprising:

an operating device that enables a first player and a second player to operate in order to advance a game;

a display that is capable of displaying a first player character corresponding to the first player and a second player character corresponding to the second player; and a controller that is programmed to execute processing operations of:

(1-1) when a first condition is established in a first game in which the first player plays, establishing a state in which the first player can start a second game to play a match with an enemy character;

(1-2) when a state in which the second game can be started is established, displaying on the display, information for inquiring whether or not the first player character and the second player character play a match with the enemy character in collaboration in the second game;

(1-3) when a signal indicating that the first and second player characters play a match with the enemy character in collaboration is output from the operating device in accordance with an operation of the second player, determining whether or not a signal indicating a predetermined participation charge is output from the operating device in accordance with the operation of the second player; and (1-4) when the signal indicating the predetermined participation charge is outputted, executing as the second game a game in which the first player characters and the second player character play a match with the enemy character in collaboration, wherein the controller executes processing operations of:

(2-1) when a second condition is established in the first game, displaying on the display a fellow character that is capable of become a fellow between the first player character and the second player character and that plays a match with the enemy character; and (2-2) determining whether or not the fellow character is handled as a fellow of the first player character, based on an operation of the operating device by the first player.

2. The gaming machine according to claim 1, wherein the controller executes processing operations of:

(3-1) determining a prize to be awarded to the first player and the second player in accordance with a match play result of the second game; and (3-2) determining an item of equipment that the first player character or the second player character is allowed to have, in accordance with a size of the prize.

3. The gaming machine according to claim 1, wherein the controller executes processing operations of:

(4-1) enabling the first player character or the second player character to select from a weapons of plural type a weapon that is employed to play a match with the enemy character in the second game;

(4-2) determining a severity of a damage to be imparted to the enemy character in accordance with a type of the selected weapon; and (4-3) determining a damage of the enemy character in the second game, and then determining a prize to be awarded to a player on condition that the severity of the determined damage becomes equal to or greater than a predetermined level.

4. The gaming machine according to claim 1, wherein the controller executes processing operations of:

(5-1) displaying on the display a map enabling the first player character to move along a predetermined route;

(5-2) displaying on the display a predetermined number of a die, based on the operation of the operating device by the first player;

(5-3) causing the first player character to move to a stop position according to the predetermined number along the route; and (5-4) defining a condition for establishing the first condition being a fact that the first player character stops at a first stop position.

5. The gaming machine according to claim 4, wherein the controller executes processing operations of:

(6-1) when the first player character moves from a frontal direction to a depth direction of the map in the processing operation (5-1), determining whether or not the first player character is positioned at a predetermined depth side on the map; and (6-2) when the first player character is positioned at the predetermined depth side on the map, redisplaying the depth side of the map on the display in an enlarged manner.

* * * * *